US012129717B2

(12) United States Patent
Smith et al.

(10) Patent No.: US 12,129,717 B2
(45) **Date of Patent: *Oct. 29, 2024**

(54) DRILL PIPE TORQUE REDUCER AND METHOD

(71) Applicant: Frank's International, LLC, Houston, TX (US)

(72) Inventors: Logan Smith, Lafayette, LA (US); Jarret Daigle, Youngsville, LA (US); Keith Lutgring, Lafayette, LA (US); Matthew Weber, Duson, LA (US); Luk Servaes, Youngsville, LA (US); Todd Simar, Lafayette, LA (US); Dustin Pitre, Youngsville, LA (US); Paul E. Sellers, Lafayette, LA (US); Dax Joseph Neuville, Broussard, LA (US); Charles M. Webre, Lafayette, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 170 days.

This patent is subject to a terminal disclaimer.

(21) Appl. No.: 17/833,032

(22) Filed: Jun. 6, 2022

(65) Prior Publication Data

US 2022/0298872 A1 Sep. 22, 2022

Related U.S. Application Data

(63) Continuation-in-part of application No. 16/898,099, filed on Jun. 10, 2020, now Pat. No. 11,352,840, and (Continued)

(51) Int. Cl.
*E21B 17/10* (2006.01)

(52) U.S. Cl.
CPC ..... *E21B 17/1064* (2013.01); *E21B 17/1078* (2013.01); *E21B 17/1085* (2013.01)

(58) Field of Classification Search
CPC ..... E21B 17/1078; E21B 17/1064; E21B 17/1085; E21B 17/105; E21B 17/16
See application file for complete search history.

(56) References Cited

U.S. PATENT DOCUMENTS 1,889,806 A 12/1932 Lamb et al.
2,813,697 A 11/1957 Swart
(Continued)

FOREIGN PATENT DOCUMENTS

CN 112761546 A 5/2021
EP 3922808 A1 12/2021
(Continued)

OTHER PUBLICATIONS

International Search Report and Written Opinion dated Nov. 28, 2018, PCT Application No. PCT/US2018/044607, filed Jul. 31, 2018, pp. 1-19.
(Continued)

*Primary Examiner* — Yong-Suk (Philip) Ro
(74) *Attorney, Agent, or Firm* — MH2 Technology Law Group, LLP

(57) ABSTRACT

An apparatus for reducing torque in a drill string includes a clamp assembly having a first clamp segment and a second clamp segment, the first and second clamp segments each being generally arcuate and configured to connect together so as to secure the clamp assembly around an oilfield tubular and prevent the clamp assembly from axial and rotational movement relative to the oilfield tubular. The first and second clamp segments each include a first extension and a second extension, each of the first and second extensions having a tapered end that decreases in outer diameter as
(Continued)

proceeding in an axial direction, so as to provide a conical guide surface. An outer sleeve is positioned around the clamp assembly, is configured to rotate with respect to the oilfield tubular and the clamp assembly, and is prevented from axial movement relative thereto.

22 Claims, 26 Drawing Sheets

Related U.S. Application Data a continuation-in-part of application No. 16/050,686, filed on Jul. 31, 2018, now Pat. No. 10,724,308.

(60) Provisional application No. 62/539,607, filed on Aug. 1, 2017.

(56) References Cited

U.S. PATENT DOCUMENTS

| | | | |
|---|---|---|---|
| 3,397,017 | A | 8/1968 | Grant et al. |
| 3,410,613 | A | 11/1968 | Kuus |
| 3,667,817 | A | 6/1972 | Kellner |
| 4,199,011 | A | 4/1980 | Kreft |
| 5,069,297 | A | 12/1991 | Krueger et al. |
| 5,579,854 | A | 12/1996 | Barry |
| 5,692,563 | A | 12/1997 | Krueger et al. |
| 5,711,386 | A | 1/1998 | Swietlik |
| 5,810,100 | A | 9/1998 | Samford |
| 5,901,798 | A | 5/1999 | Herrera et al. |
| 6,032,748 | A | 3/2000 | DeBray et al. |
| 6,250,406 | B1 | 6/2001 | Luke |
| 6,739,415 | B2 | 5/2004 | Mitchell et al. |
| 6,962,205 | B1 | 11/2005 | Lay, Jr. |
| 7,025,136 | B2 | 4/2006 | Tulloch et al. |
| 7,055,631 | B2 | 6/2006 | Mitchell et al. |
| 7,159,619 | B2 | 1/2007 | Latiolais, Jr. |
| 7,938,202 | B2 | 5/2011 | Mitchell et al. |
| 8,511,377 | B2 | 8/2013 | Casassa et al. |
| 8,668,007 | B2 | 3/2014 | Casassa et al. |
| 8,863,834 | B2 | 10/2014 | Buytaert et al. |
| 8,919,450 | B1 | 12/2014 | Cruz |
| 9,109,417 | B2 | 8/2015 | Leiper et al. |
| 9,115,546 | B2 | 8/2015 | Howlett |
| 9,140,391 | B2 | 9/2015 | Pajak et al. |
| 9,441,772 | B2 | 9/2016 | Pajak et al. |
| 9,598,913 | B2 | 3/2017 | Buytaert et al. |
| 10,294,734 | B2 | 5/2019 | Buytaert et al. |
| 10,724,305 | B2 | 7/2020 | Smith |
| 10,724,308 | B2 * | 7/2020 | Smith ..... E21B 17/1078 |
| 11,352,840 | B2 * | 6/2022 | Smith ..... E21B 17/16 |
| 2009/0308617 | A1 | 12/2009 | Minto |
| 2015/0008042 | A1 | 1/2015 | Buytaert et al. |
| 2017/0030151 | A1 | 2/2017 | Lutgring et al. |
| 2020/0300047 | A1 | 9/2020 | Smith et al. |
| 2021/0079740 | A1 | 3/2021 | Baynham et al. |

FOREIGN PATENT DOCUMENTS

| | | | |
|---|---|---|---|
| GB | 2595333 | A | 11/2021 |
| WO | 98-40601 | A1 | 9/1998 |
| WO | 2001/059249 | | 8/2001 |

OTHER PUBLICATIONS

Search and Examination Report dated Oct. 19, 2023, GB Application No. 2308404.9, 5 pages.

* cited by examiner

DRILL PIPE TORQUE REDUCER AND METHOD

CROSS-REFERENCE TO RELATED APPLICATIONS

This application is a continuation-in-part of U.S. patent application having Ser. No. 16/898,099, which was filed on Jun. 10, 2020 and is a continuation-in-part of U.S. patent application having Ser. No. 16/050,686, which was filed on Jul. 31, 2018 and claims priority to U.S. Provisional Patent application having Ser. No. 62/539,607, which was filed on Aug. 1, 2017. Each of these priority applications is incorporated herein by reference in its entirety.

BACKGROUND

Drill strings are made of a series of drill pipes that are connected together. A drill bit is generally positioned at the lower end of the drill string to bore through the earth and create a well, enabling the recovery of hydrocarbons from subterranean reservoirs. Individual drill pipes typically have radially enlarged end connections, which allow for the drill pipes to be connected together, either end-to-end or using collars, to form the drill string. During drilling operations, the drill bit is rotated by rotating the drill string. The drill string is suspended from a drilling rig and is in tension, but in order to apply weight to cause the drill bit to bite into the earth, a bottom hole assembly is positioned just above the drill bit. The bottom hole assembly is, in effect, a number of weighted drill collars.

In extended-reach drilling, the drill bit can be several miles laterally displaced from the foot of the rig. In horizontal drilling, the bit follows an arcuate path and then drills a horizontal bore. In both extended-reach drilling and horizontal drilling, transmission of power from the rig to the drill bit may be hindered by frictional losses generated by contact between the enlarged, connected end portions of the drill pipes and the inner surface of the wellbore and/or casing that lines the wellbore.

To protect the drill string from abrasion against the side wall of the wellbore or casing, a drill pipe protector can be employed. Drill pipe protectors are typically elastomer elements that are clamped or otherwise secured to the outer diameter of the drill pipe. Such drill pipe protectors generally prevent the drill pipe from contacting inner surface of the casing or wellbore, thereby avoiding or at least mitigating frictional contact between the drill pipe body and the inner surface of the wellbore. Without a drill pipe protector, the drill string is subjected to shock and abrasion when the drill string comes into contact with the side wall of the wellbore or the casing.

Rotating drill pipe protectors have been implemented that allow for rotation between the drill pipe and the drill pipe protector, such that the drill pipe does not contact the wellbore when the rotating drill pipe is being rotated. Rotation of a drill string with respect to the rotating drill pipe protector may, however, create frictional torque on the drill string, even if to a lesser degree than the drill pipe directly engaging the casing/wellbore wall. Additionally, rotation of the drill string with respect to the rotating drill pipe protector may lead to wear and abrasions on the outer surface of the drill pipes of the drill string, and thus, may lead to a shorter life span of the drill pipe and/or the drill pipe protector.

SUMMARY

Embodiments of the disclosure include an apparatus for reducing torque in a drill string that includes a clamp assembly having a first clamp segment and a second clamp segment, the first and second clamp segments each being generally arcuate and configured to connect together so as to secure the clamp assembly around an oilfield tubular and prevent the clamp assembly from axial and rotational movement relative to the oilfield tubular. The first and second clamp segments each include a first extension and a second extension, each of the first and second extensions having a tapered end that decreases in outer diameter as proceeding in an axial direction, so as to provide a conical guide surface. An outer sleeve is positioned around the clamp assembly, is configured to rotate with respect to the oilfield tubular and the clamp assembly, and is prevented from axial movement relative thereto.

Embodiments of the disclosure include a method, including securing a first clamp segment together with a second clamp segment and around a tubular, such that the first and second clamp segments resist axial and radial movement relative to the tubular. The first and second clamp segments each include first and second extensions, each of the first and second extensions having a tapered end. The method also includes positioning an outer sleeve around the first and second clamp segments. The outer sleeve is configured to rotate relative to the first and second clamp segments, and the outer sleeve is received axially between the tapered ends of the first clamp segment and axially between the tapered ends of the second clamp segment.

Embodiments of the disclosure include an apparatus for reducing torque in a drill string. The apparatus includes a clamp assembly including a first clamp segment and a second clamp segment, the first and second clamp segments each being generally arcuate and configured to connect together so as to secure the clamp assembly around an oilfield tubular and prevent the clamp assembly from axial and rotational movement relative to the oilfield tubular. The first and second clamp segments each include a first extension and a second extension, each of the first and second extensions having a tapered end that decreases in outer diameter as proceeding in an axial direction, so as to provide a conical guide surface. The first and second clamp segments each include at least one radial protrusion and at least two recesses. The clamp assembly further includes a plurality of lock inserts each having a tapered profile and configured to fit radially between the first clamp segment, the second clamp segment, or both and the oilfield tubular, so as to secure the clamp assembly to the oilfield tubular. The lock inserts each include a plurality of insert segments, and the first clamp segment and the second clamp segment each include a plurality of pockets on an inner surface thereof, the insert segments being configured to be positioned in the pockets between axially-extending walls of the first and second clamp segments. The apparatus also includes an outer sleeve positioned around the clamp assembly and including at least one radial protrusion configured to fit into the at least one recess of the first and second clamp segments, and at least one recess configured to receive the at least one protrusion of the first and second clamp segments, such that multiple load-transferring interfaces are formed between shoulder surfaces of the clamp assembly and shoulder surfaces of the outer sleeve. The outer sleeve is configured to rotate with respect to the oilfield tubular and the clamp assembly, and is prevented from axial movement relative thereto, wherein the first and second clamp segments each include a central body defining a recessed region, and the outer sleeve includes an inwardly-extending protrusion configured to be received at least partially into the recessed region, so as to retain an axial positioning of the outer sleeve relative to the clamp assembly.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
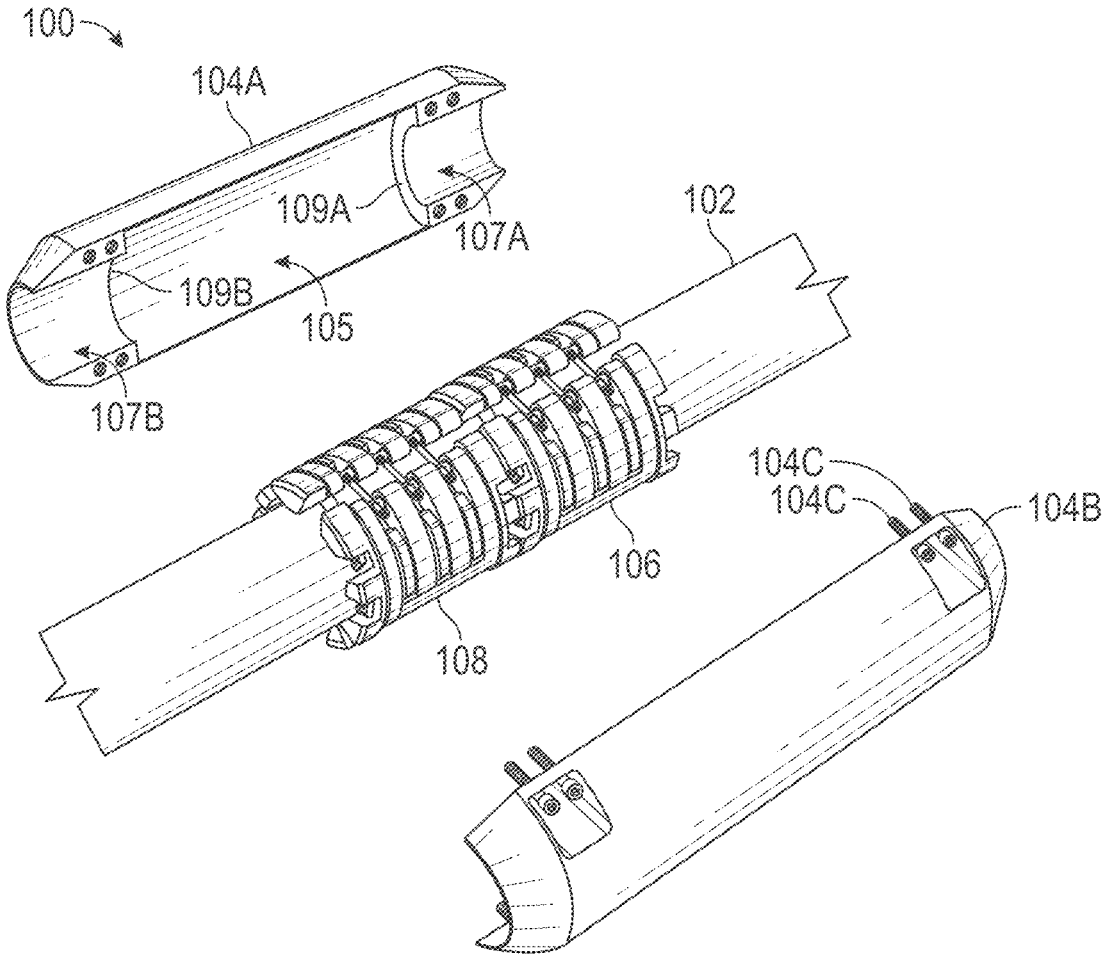
FIG. 1 illustrates a perspective, exploded view of a torque reducer installed on a drill pipe, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate like elements, where convenient. The following description is merely a representative example of such teachings.

FIG. 1 illustrates a perspective, exploded view of a torque reducer 100 coupled to a drill pipe 102, according to an embodiment. Although described herein as being coupled to a drill pipe 102, it will be appreciated that the torque reducer 100 may be readily adapted for application with other types of oilfield tubulars, e.g., casing. The torque reducer 100 may include one or more clamp assemblies, e.g., a first clamp assembly 106 and a second clamp assembly 108. The clamp assemblies 106, 108 may be received around and connected together, so as to secure the clamp assemblies 106, 108 to the drill pipe 102, as will be described in greater detail below. As illustrated, the first and second clamp assemblies 106, 108 may be positioned axially-adjacent to one another. In other embodiment, the first and second clamp assemblies 106, 108 may be separated axially apart. As the term is used herein, "axially" means generally in a direction parallel to a central longitudinal axis of the drill pipe 102 (or any other oilfield tubular to which the inner member(s) may be secured). In some embodiments, the first and second clamp assemblies 106, 108 may be substantially identical, e.g., functionally the same, but potentially with some minor differences, e.g., incidental differences such as machining tolerances. In other embodiments, the two clamp assemblies 106, 108 may be of different designs.

The torque reducer 100 may also include an outer sleeve 104, which may, as shown, be provided as a pair of sleeve segments 104A, 104B securable together using fasteners 104C (e.g., bolts). In other embodiments, the sleeve segments 104A, 104B may be otherwise connected together, such as by adhering, clamping, crimping, etc. In some embodiments, the sleeve segments 104A, 104B may be hinged on one circumferential side and removably coupled together (e.g., fastened) on the opposite circumferential side. It will be appreciated that any number of sleeve segments 104A, 104B may be employed. The combination of the sleeve segments 104A, 104B, are positioned entirely around the first and second clamp assemblies 106, 108, so as to fully envelope the clamp assemblies 106, 108.

The outer sleeve 104 may define a central, receiving region 105 and two end regions 107A, 107B. As shown, portions of the receiving region 105 and the end regions 107A, 107B may be defined in each of the sleeve segments 104A, 104B. The receiving region 105 may define an inner diameter that is larger than the inner diameter of the two end regions 107A, 107B. The receiving region 105 may be configured to receive the clamp assemblies 106, 108, while the end regions 107A, 107B may be configured to be received (e.g., directly) around the drill pipe 102 (or potentially with one or more other structures therebetween). Shoulders 109A, 109B may be defined at the transition between the end regions 107A, 107B and the clamp-receiving region 105. The shoulders 109A, 109B may be located on opposite axial sides of the clamp assemblies 106, 108 when the torque reducer 100 is assembled.

The inner diameter of the outer sleeve 104 in the clamp-receiving region 105 may be slightly larger than an outer diameter of the clamp assemblies 106, 108. The inner diameter of the end regions 107A, 107B may be slightly larger than the outer diameter of the drill pipe 102; however, the radial clearance between 107 and drill pipe 102 is greater than clearance between 105 and 106. Accordingly, the outer sleeve 104 may be rotatable relative to the clamp assemblies 106, 108 and the drill pipe 102, in a manner similar to a plain bearing. By contrast, the clamp assemblies 106, 108 may be secured in position on the drill pipe 102, and may thus rotate therewith, e.g., relative to the outer sleeve 104 and/or the surrounding wellbore (e.g., a stationary frame of reference). For example, the clamp assemblies 106, 108 may be configured to facilitate such relative rotation between the clamp assemblies 106, 108 and the outer sleeve 104 by providing a low-friction, wear-resistant engagement therebetween, as will be described in greater detail below.

Figure 2:
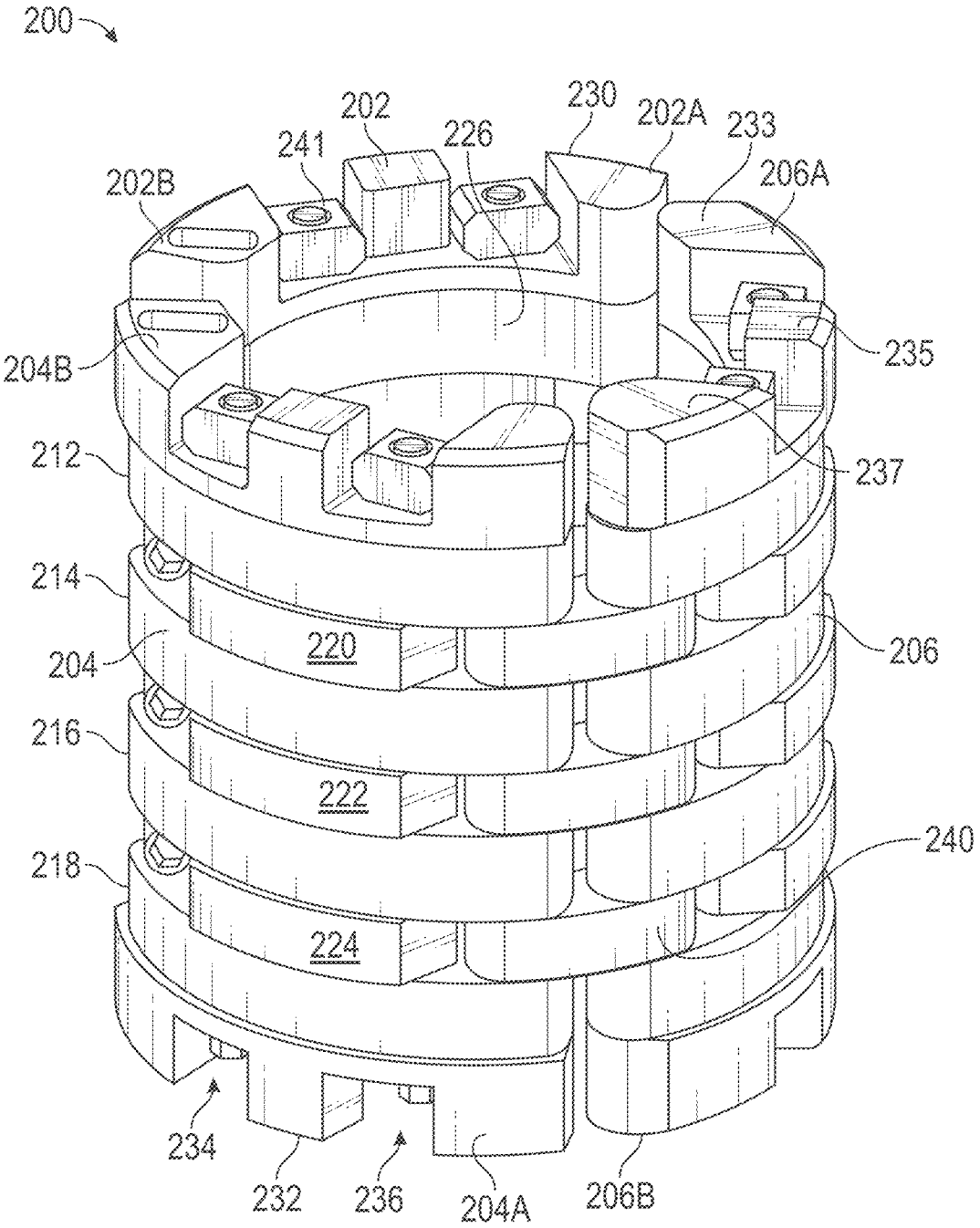
FIG. 2 illustrates a perspective view of a clamp assembly of the torque reducer, according to an embodiment.

FIG. 2 illustrates a perspective view of a clamp assembly 200, according to an embodiment. The clamp assembly 200 embodiments discussed herein may be representative of either or both of the clamp assemblies 106, 108 discussed above. Moreover, the two clamp assemblies 106, 108 may be of the same construction, or may be provided by two different embodiments, without limitation. The clamp assembly 200 may include a plurality of arcuate clamp segments, e.g., a first arcuate clamp segment 202, a second arcuate clamp segment 204, and an intermediate clamp segment 206 (collectively referred to herein as clamp segments 202-206). It will be appreciated that the intermediate clamp segment 206 may be made of a single segment (as shown) or two or more individual segments, such that the clamp assembly 200 may be made of any number of segments deemed suitable. In some cases, providing a third/intermediate clamp segment 206, in addition to the first and second clamp segments 202, 204, may provide an additional degree of tolerance for the shape of the drill pipe 102 (FIG. 1), such that the clamp assemblies 106, 108 are better able to account for ovality or variations in diameter of the drill pipe 102. Each of the clamp segments 202-206 may be about equal in circumferential width, e.g., about 120 degrees in embodiments with three segments 202-206.

Although FIG. 2 illustrates the clamp assembly 200 having three arcuate clamp segments 202-206, in some embodiments, the clamp assembly 200 may include two arcuate clamp segments instead. In some cases, two segments may provide higher axial holding force than three segments. In such embodiments, the clamp segments may be about equal in circumferential length, e.g., about 180 degrees.

In the illustrated embodiment, each of the clamp segments 202, 204, 206, may include circumferential ends 202A, 202B, 204A, 204B, 206A, 206B, respectively (collectively referred to herein as circumferential ends 202A-206B). At least some of the circumferential ends 202A-206B may be configured to be pivotally coupled to one another, and some of the circumferential ends 202A-206B may be removably coupled together so as to allow the clamp assembly 200 to be received around and secured to the drill pipe 102 or another tubular.

For example, the circumferential end 202A of the first clamp segment 202 may be pivotally coupled to the circumferential end 206A of the intermediate clamp segment 206. The circumferential end 206B of the intermediate clamp segment 206 may be pivotally coupled to the circumferential end 204A of the second clamp segment 204. Once received around the drill pipe 102, for example, the circumferential end 202B of the first clamp segment 202 may be removably (and potentially adjustably and/or pivotally) connected to the circumferential end 204B of the second clamp segment 204, e.g., using bolts, as will be described in greater detail below.

The clamp segments 202-206 may each include one or more structural members (four are shown for each segment, e.g., 212, 214, 216, 218; collectively referred to herein as structural members 212-218), and one or more radial wear members (three are shown, e.g., 220, 222, 224; collectively referred to herein as radial wear members 220-224), which are also a part of the structure. The structural members 212-218 may be arcuate and made from a relatively strong (as compared to the radial wear members 220-224) material, such as steel, although other materials are contemplated. The radial wear members 220-224 may also be arcuate and may be made from a material providing a relatively low coefficient of friction (as compared to the structural members 212-218), such as brass, composite (e.g., a fiber-reinforced) material, plastic, or a combination thereof, although other materials are contemplated. Also, in some embodiments, the radial wear members 220-224 may be coated with a material to provide a relatively low coefficient of friction, in comparison to the main body thereof. In some embodiments, the structural members 212-218 may extend along a greater arc than the radial wear members 220-224, so as to provide for connection between the clamp segments 202-206. Further, the structural members 212-218 may be separated axially apart, and may be interleaved with the radial wear members 220-224 (i.e., the radial wear members 220-224 may each be positioned between two of the structural members 212-218).

The clamp segments 202-206 may each include arcuate axial wear members 230, 232, which may be positioned on opposite axial ends of the clamp segments 202-206 and connected to the end structural members 212, 218. The arcuate axial wear members 230, 232 may each include two or more recesses 234, 236, in which bolts 241 may be positioned. The recesses 234, 236 may be positioned between wear surfaces 233, 235, 237. The bolts 241 may extend through the assembly of axial wear members 230, 232, radial wear members 220-224, and structural members 212-218, so as to fasten the assembly together. The recesses 234, 236 may provide a pocket such that the bolt 241 ends are prevented from engaging adjacent surfaces, allowing for the low-friction material of the axial wear members 230, 232 (e.g., on the wear surfaces 233, 235, 237) to provide the axial extents of the clamp assembly 200 and thus engage axially adjacent structures, as will be described in greater detail below. It will be appreciated that the assembly 200 may be connected together in a variety of different ways, with the illustrated bolts 241 being just one among many contemplated. For example, in other embodiments, the wear members 220-224, 230, 232 may be connected via pins, dovetail geometry, bonding, etc.

The radial wear members 220-224, and potentially the axial wear members 230, 232 as well, may have a greater radial thickness than the structural members 212-218. For example, the radial wear members 220-224, the structural members 212-218, and the axial wear members 230, 232 may together define an inner surface 226 of each of the clamp assembly 200, which may be generally constant and configured to engage the drill pipe 102 (FIG. 1). However, due to the greater radial thickness, the radial wear members 220-224 (and/or the axial wear members 230, 232) may protrude radially outward from the outer-most radial extent of the structural members 212-218.

As mentioned above, the circumferential end 206B of the intermediate clamp segment 206 may be pivotally coupled to the circumferential end 204A of the second clamp segment 204. In the illustrated embodiment, a plurality of links 240 may provide such pivotal coupling. For example, each of the plurality of links 240 may be positioned circumferentially adjacent to one of the radial wear members 220-224 and axially between two of the structural members 212-218. A pin may extend through the structural members 212-218 and the links 240 on each of the clamp segments 204, 206, thereby providing for a pivotal connection. The first segment 202 and the intermediate segment 204 may be similarly, pivotally coupled together with links.

In at least one embodiment, at least one of the clamp segments 202-206 may include a magnetic element configured to attract the at least one of the clamp segments 202-206 to the drill pipe 102 during installation. In some embodiments, the magnetic element may be integrated into (i.e., be a magnetized part of or embedded within) one or more of the structural members 212-218, radial wear members 220-224, and/or axial wear member 230, 232.

Figure 3:
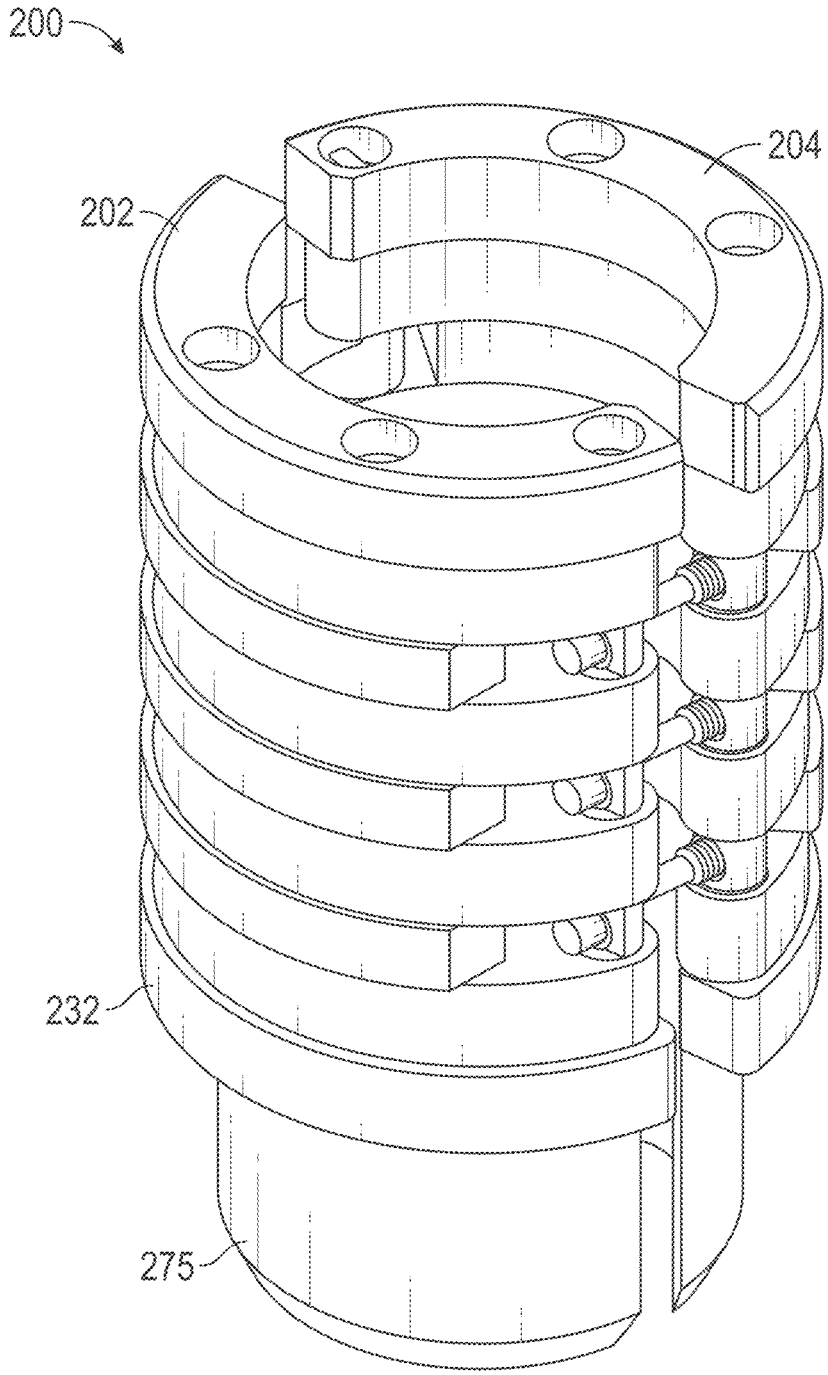
FIG. 3 illustrates a perspective view of another embodiment of a clamp assembly.

FIG. 3 illustrates a perspective view of another embodiment of the clamp assembly 200. The clamp assembly 200 includes only two arcuate clamp segments 202, 204, omitting the third (e.g., 224 in FIG. 2). Further, the clamp assembly 200 of FIG. 3 includes an extension 275 which extends axially from one of the axial wear members, e.g., axial wear member 232. The extension 275 may be configured to fit radially between the outer sleeve 104 and the drill pipe 102 (see FIG. 1). The extension 275 may provide a barrier between the inner diameter of the outer sleeve 104 and the outer diameter of the drill pipe 102 as the drill pipe 102 rotates relative to the outer sleeve 104.

Figure 4:
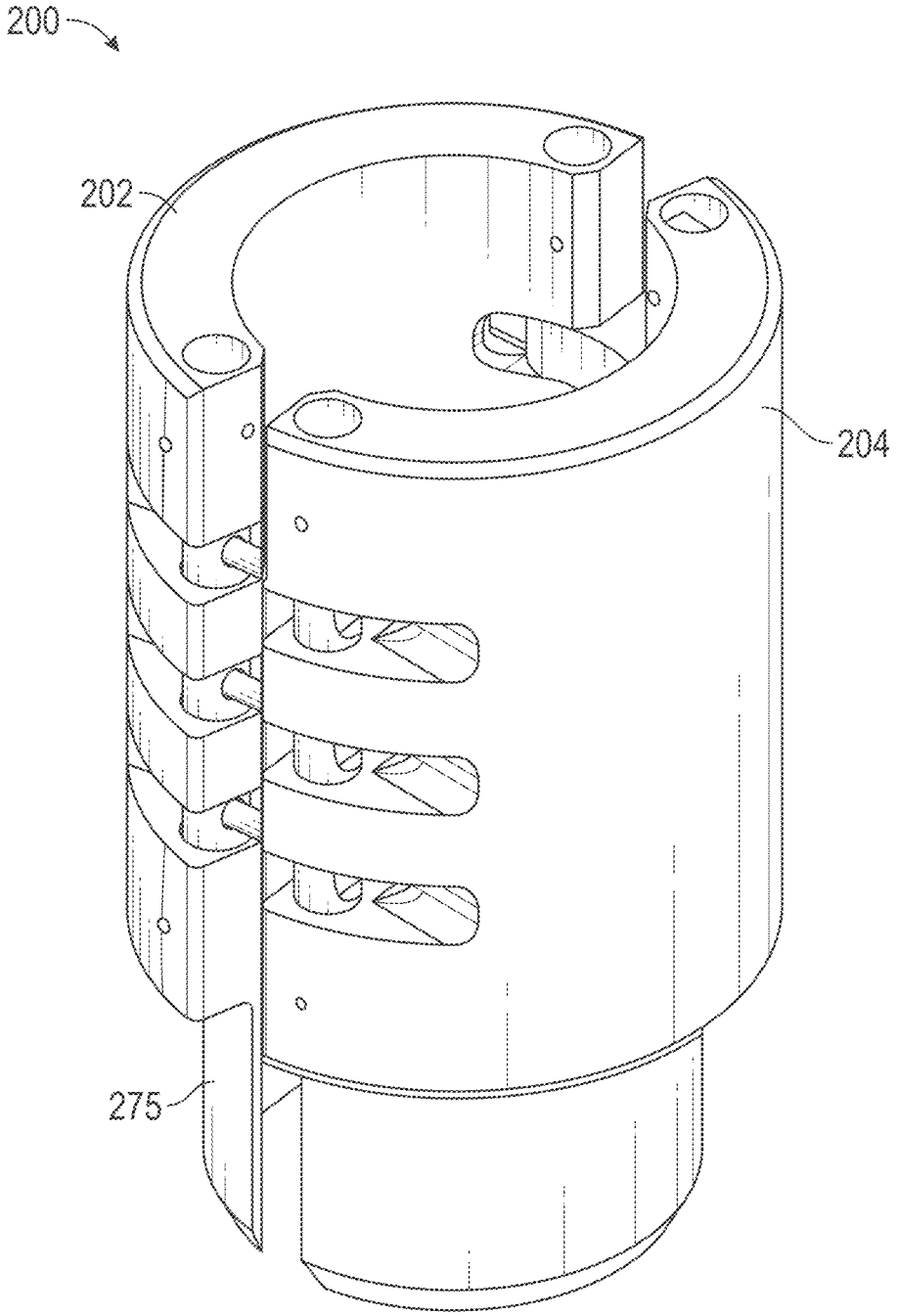
FIG. 4 illustrates a perspective view of another embodiment of a clamp assembly.

FIG. 4 illustrates a perspective view of another embodiment of the clamp assembly 200. As shown, the clamp assembly 200 includes the arcuate clamp segments 202, 204 (again, omitting the third segment 224, as shown in FIG. 2). In some embodiments, three or more segments may be employed. In this embodiment, the clamp segments 202, 204 are each made from a solid piece of material. The particular material may be any material that meets the strength requirements to perform the intended gripping function.

The outer surface of these clamp segments 202, 204 may be generally continuous in an axial direction, as shown (e.g., not including interleaved, axially-adjacent segments), and may be coated with a material providing a relatively low coefficient of friction so as to reduce friction between the clamp assembly outer surface and the inner surface of the outer sleeve during operation. This embodiment also includes the extension 275, extending from the lower (as viewed in the figure) axial end of the clamp segments 202, 204. The solid bodies of the clamp segments 202, 204 may extend, as a unitary piece from the extension 275 to the opposite axial end of the clamp assembly 200. In some embodiments, as shown, the extension 275 may form an integral part of the clamp segments 202, 204, and thus the solid body of the clamp segments 202, 204 may be considered to extend entirely between the axial ends of the clamp segment 202, 204.

Figure 5:
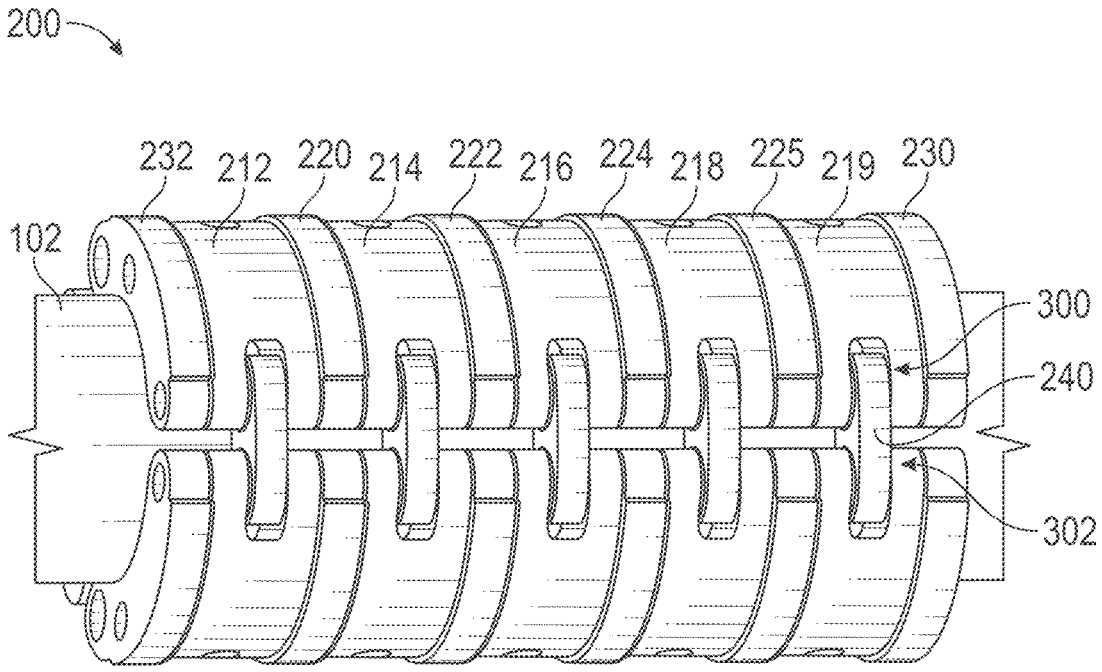
FIG. 5 illustrates a perspective view of another embodiment of the clamp assembly.

FIG. 5 illustrates a perspective view of another embodiment of the clamp assembly 200. As mentioned above, any number of structural members 212-218 and/or any number of radial wear members 220-225 may be employed. Demonstrating this point, the clamp assembly 200 provides an additional structural member 219 and an additional radial wear member 225. As shown, the radial wear members 220-225 may extend along the same arc as the structural members 212-219. To pivotally connect the ends (e.g., ends 202A and 206A) together, as shown in FIG. 5, clevises 300, 302 may be machined or otherwise formed into the ends of the structural members 212-219. The links 240 may thus be pivotally coupled to the structural members 212-219 in the clevises 300, 302, rather than axially between structural members 212-219.

Figure 6:
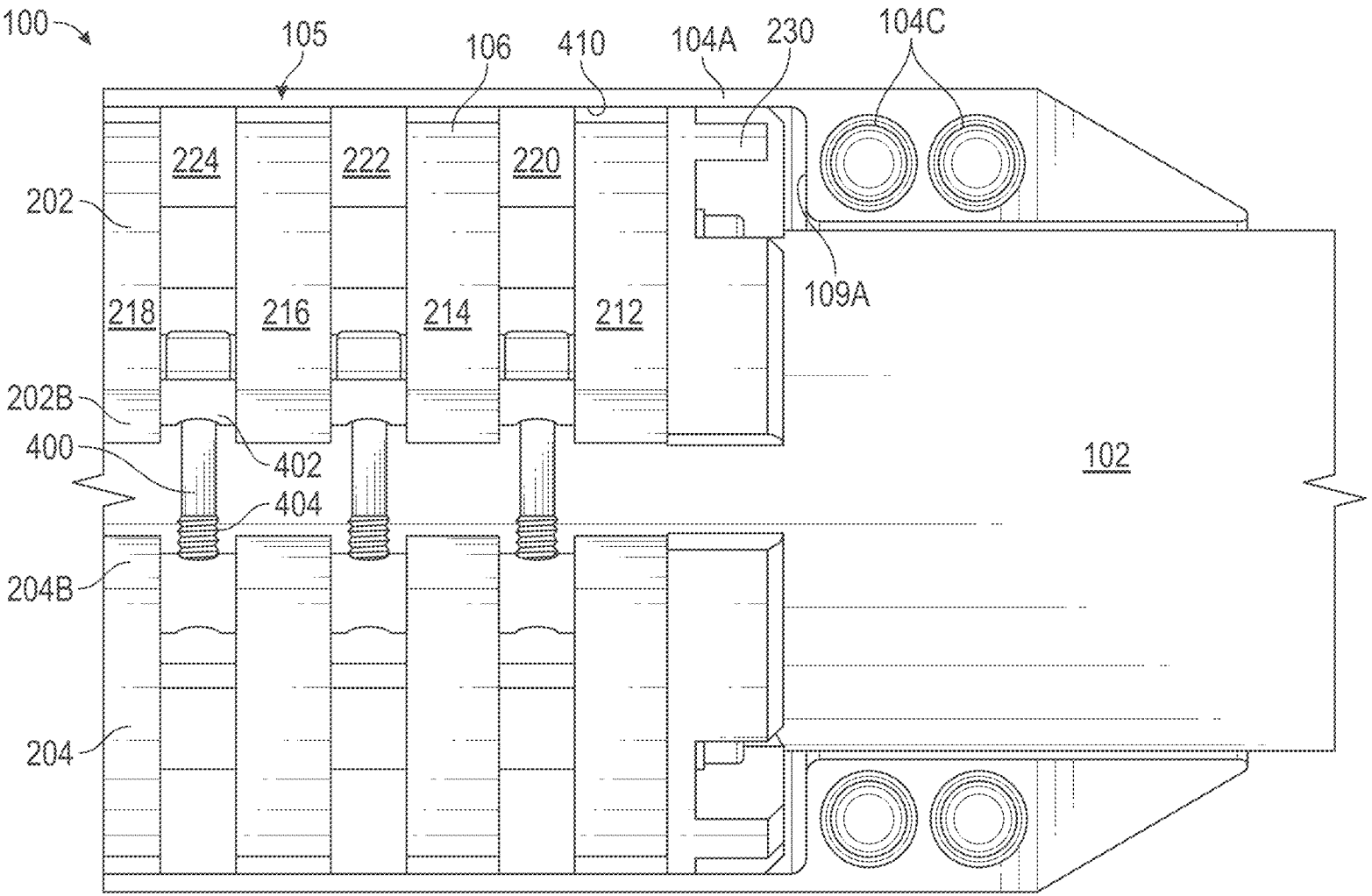
FIG. 6 illustrates a side view of a portion of the torque reducer of FIG. 1 installed on a drill string, according to an embodiment.

FIG. 6 illustrates a side view of the torque reducer 100, with one of the sleeve segments 104A positioned around one of the clamp assemblies 106, according to an embodiment. As mentioned above, the clamp assembly 106 may be formed as described with respect to an embodiment of the clamp assembly 200, and like elements are referenced by the same numbers. In particular, FIG. 6 depicts the circumferential ends 202B, 204B of the first and second clamp segments 202, 204 being connected together. As shown, fasteners 400, such as bolts, may be provided to make an adjustable and removable connection for the first and second clamp segments 202, 204. In particular, the adjustability of the connection may allow for the total circumference of the clamp assembly 200 to be adjusted, e.g., reduced, so as to adjust a gripping force applied by the clamp assembly 200 on the drill pipe 102.

For example, the fasteners 400 may be positioned between axially-adjacent structural members 212-218. The fasteners 400 may extend through pins 402 formed in the first clamp segment 202 and may be threaded into holes 404 provided in a corresponding location on the second clamp segment 204. As such, turning the fasteners 400 may serve to draw the first and second clamp segments 202, 204 closer together and reduce the overall circumference of the clamp assembly 106, thereby causing the clamp assembly 106 to grip the drill pipe 102. It will be appreciated that such adjustable and/or removable connection may be made using a variety of other structures, and that the clamp assembly 200 may include two or more sets of circumferential ends connected together in this manner.

FIG. 6 also illustrates the interaction between the sleeve segment 104A, a portion of the clamp assembly 106, and the drill pipe 102, which may be illustrative of similar interactions involving the remainder of the clamp assembly 106, sleeve segment 104B, and/or clamp assembly 108 as well. As shown, the clamp assembly 106 is received in the clamp-receiving region 105. In particular, an inner diameter surface 410 of the sleeve segment 104A engages an outer surface of at least some of the radial wear members 220-224 and an outer surface of the axial wear member 230. Further, the inner diameter surface 410 is held spaced apart from the structural members 212-218 by the protruding of the radial wear members 220-224. Thus, the low-friction wear material of the radial wear members 220-224 promotes low-friction, wear-resistant engagement between the relatively rotatable outer sleeve 104 and the clamp assembly 106.

Further, the shoulder 109A is closely proximal (e.g., potentially engaging) the axial wear member 230. Accordingly, when an axial load (e.g., to the left, in the illustration) is present, the shoulder 109A may engage the low-friction material of the axial wear member 230, thereby mitigating friction forces that would otherwise tend to impede relative rotation between the outer sleeve 104 and the clamp assembly 106. It will be appreciated that the interaction between the shoulder 109B (see FIG. 1) and the axial wear member 232 (see FIG. 2) may act similar in the presence of axial load in the opposite direction.

Figure 7:
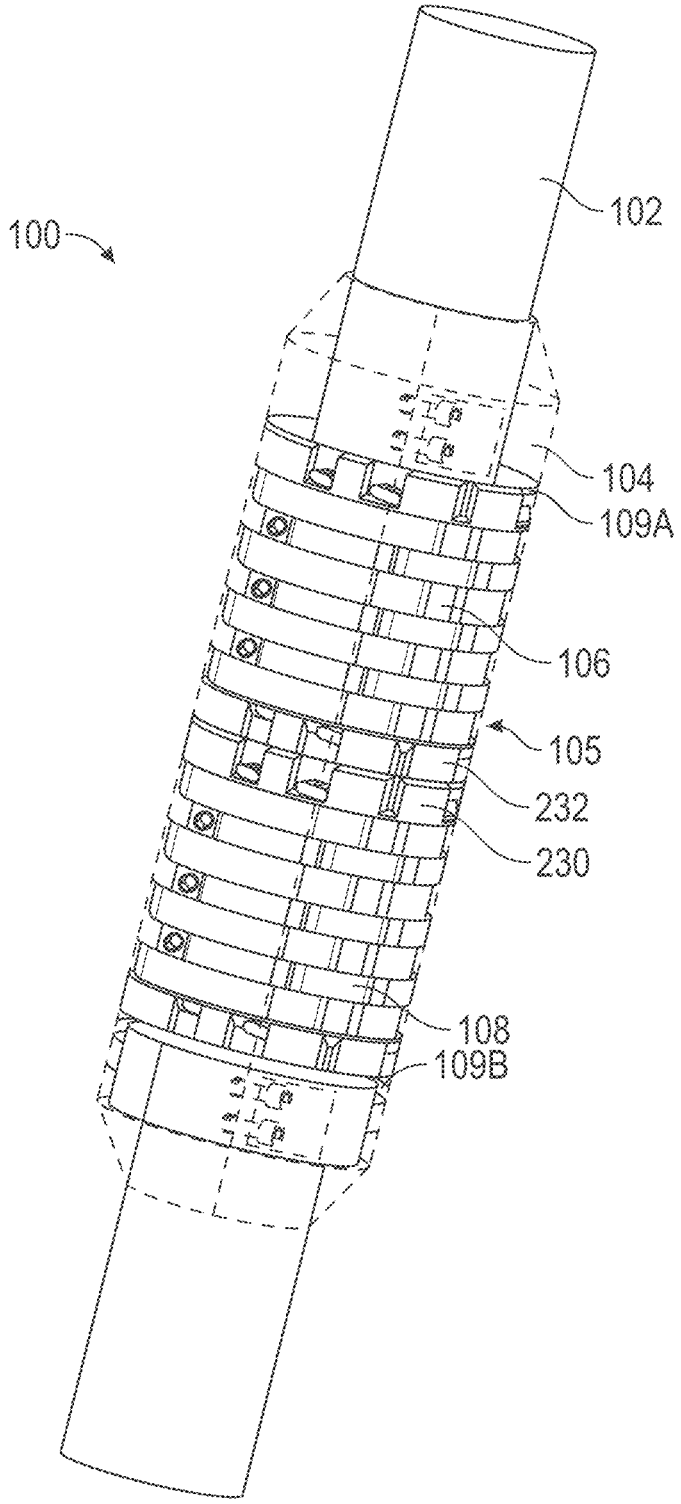
FIG. 7 illustrates a perspective view of the torque reducer installed on a drill string, with an outer sleeve thereof shown as transparent, for purposes of viewing the interior thereof, according to an embodiment.

FIG. 7 illustrates a perspective view of the torque reducer 100, with the outer sleeve 104 assembled over the clamp assemblies 106, 108, according to an embodiment, and shown as transparent, to allow viewing of the clamp assemblies 106, 108. The clamp assemblies 106, 108 being adjacent to each other may result in the axial wear member 232 of the first clamp assembly 106 engaging the axial wear member 230 of the second clamp assembly 108. Further, the first and second clamp assemblies 106, 108 are positioned in the clamp-receiving region 105, between the shoulders 109A, 109B. The clamp assemblies 106, 108 may be integral, making up one single assembly equal in length to the combination of the clamp assemblies 106, 108

Figure 8:
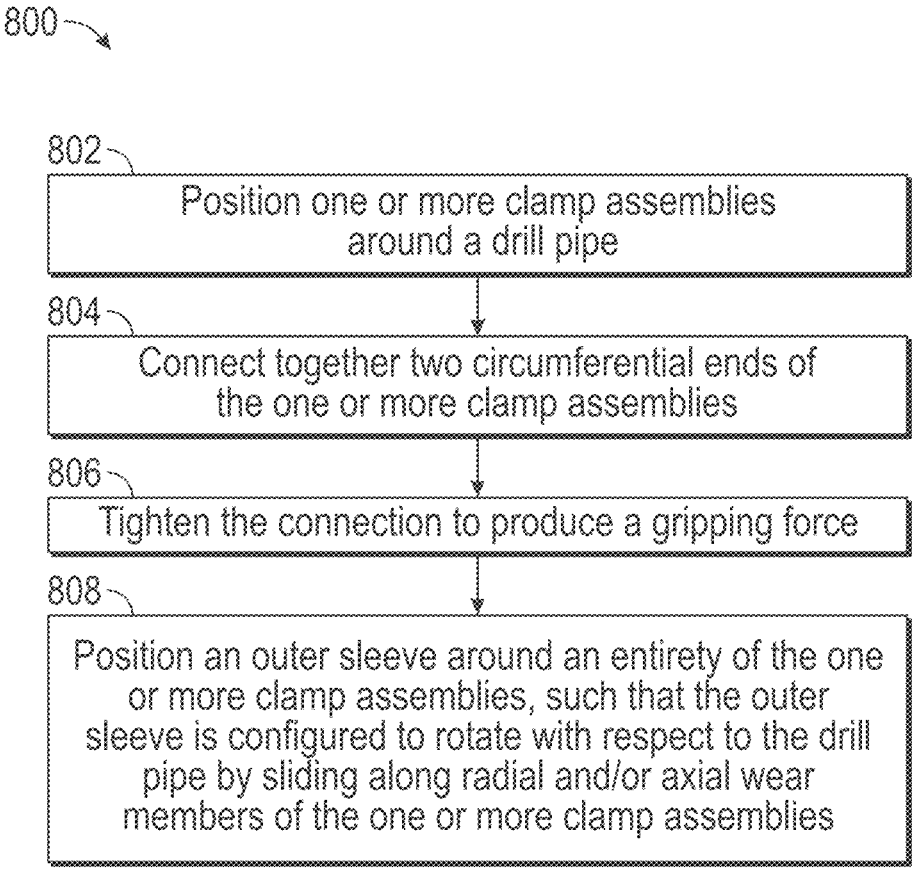
FIG. 8 illustrates a flowchart of a method for installing a torque reducer on a drill pipe, according to an embodiment.

FIG. 8 illustrates a flowchart of a method 800 for installing a torque reducer, according to an embodiment. The method 800 may be implemented using an embodiment of the torque reducer 100 described above with reference to FIGS. 1-7, and thus may be best understood by reference thereto. Some embodiments may, however, be implemented using other structures, and thus the present method 800 should not be considered limited to any particular structure unless otherwise stated herein.

Figure 9:
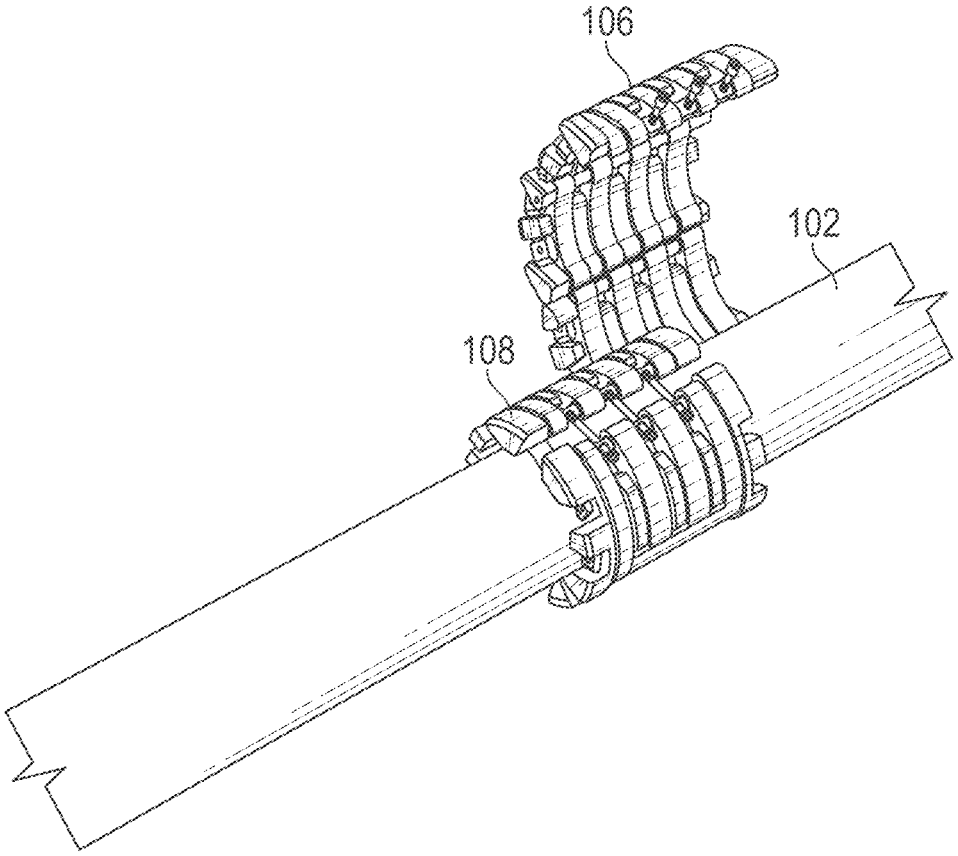
FIG. 9 illustrates a perspective view of a pair of inner assemblies of a torque reducer being installed on a drill pipe, according to an embodiment.

The method 800 may begin by positioning one or more clamp assemblies 106, 108 around a drill pipe 102, as at 802. FIG. 9 illustrates, according to an example, the first clamp assembly 106 in the process of being positioned around the drill pipe 102, with the axially-adjacent second clamp assembly 108 having already been positioned around the drill pipe 102. The clamp assemblies 106, 108 may be received laterally onto the drill pipe 102, e.g., rather than over an end thereof. As described above, the segments 202-206 of the clamp assemblies 106, 108 may be pivotally coupled together, allowing the clamp assemblies 106, 108 to articulate and move open and closed. This may facilitate receiving the clamp assemblies 106, 108 around the drill pipe 102, including situations in which the drill pipe 102 is not perfectly round and varies from a nominal diameter thereof. In some embodiments, at least a portion of at least one of the clamp assemblies 106, 108 may be magnetic, so as to attract the clamp assembly 106, 108 to the drill pipe 102 and facilitate installation.

The method 800 may also include connecting together two circumferential ends 202B, 204B of clamp segments 202, 204 of the one or more clamp assemblies 106, 108, as at 804. As best shown in FIG. 6, the clamp segment ends 202B, 204B may be connected together so as to hold the clamp segment 106 around the drill pipe 102. A variety of different connections may be employed to hold the circumferential ends 202B, 204B together. In some embodiments, the connections may be made by bolts or other adjustable fasteners. In such case, the method 800 may include tightening the connection to produce a gripping force that holds the clamp assemblies 106, 108 to the drill pipe 102, as at 806. In other embodiments, the connection may not require tightening to produce the gripping force.

The method 800 may also include positioning an outer sleeve 104 around an entirety of the one or more clamp assemblies 106, 108, such that the outer sleeve 104 is configured to rotate with respect to the drill pipe by sliding along radial and/or axial wear members of the one or more clamp assemblies, as at 808.

Figure 10:
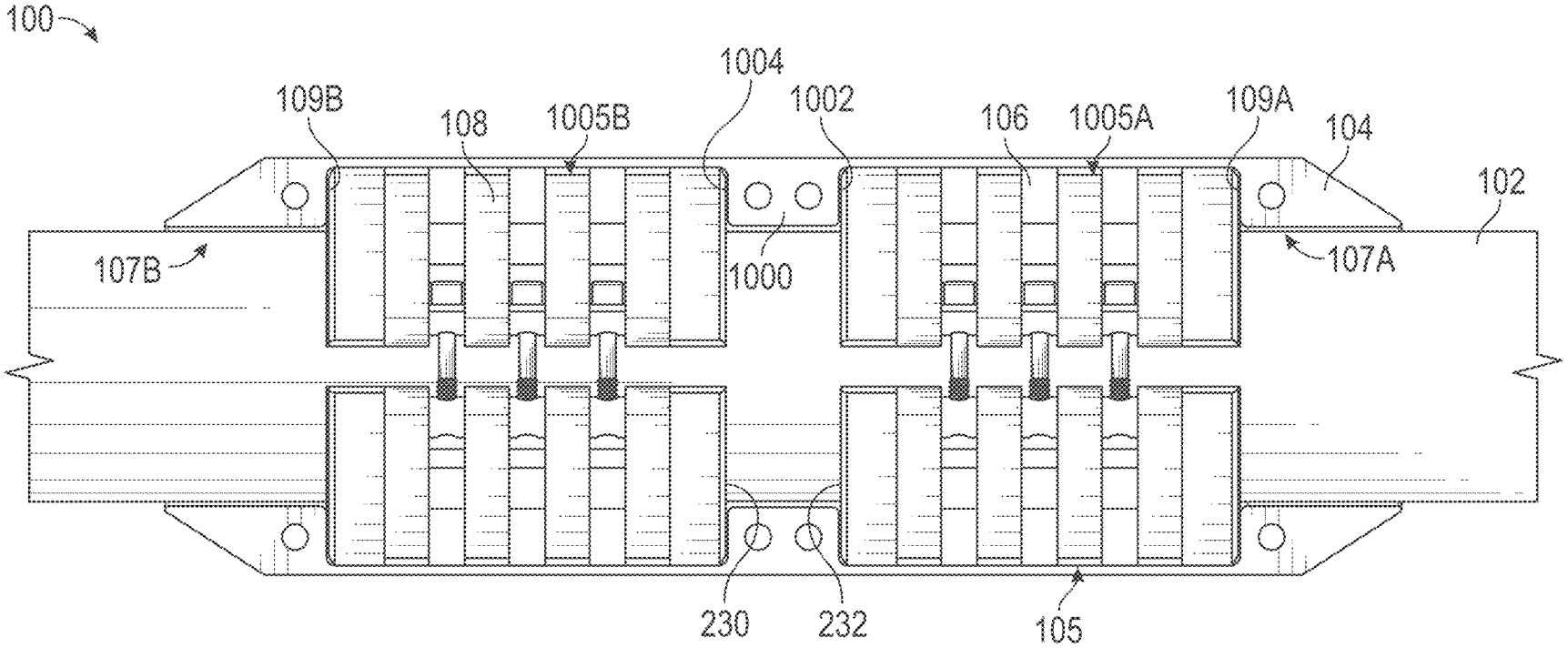
FIG. 10 illustrates a side view of another embodiment of the torque reducer.

FIG. 10 illustrates a side view of another embodiment of the torque reducer 100. In this embodiment, the torque reducer 100 includes the first and second clamp assemblies 106, 108, which are positioned around and tightened to grip the drill pipe 102. The clamp assemblies 106, 108 are also spaced axially apart in this embodiment. The outer sleeve 104, which is assembled around the clamp assemblies 106, 108, includes a medial shoulder 1000 that extends inwards in the clamp-receiving region 105. The medial shoulder 1000 is configured to be positioned axially intermediate of the spaced-apart first and second clamp assemblies 106, 108, as shown. The medial shoulder 1000 may have two axially-facing surfaces 1002, 1004, which face in opposite axial directions.

The medial shoulder 1000 may thus partition the clamp-receiving region 105 into two, smaller clamp-receiving portions 1005A, 1005B, each receiving one of the clamp assemblies 106, 108. The clamp-receiving portions 1005A, 1005B may have an axial length that is slightly larger than the axial length of the clamp assembly(ies) 106, 108 positioned therein, such that some amount of axial clearance is provided between the outer sleeve 104 and the clamp assemblies 106, 108. It will be appreciated that two or more clamp assemblies may be positioned in either or both of the clamp-receiving portions 1005A, 1005B. Moreover, it will be appreciated that the outer sleeve 104 may include more than one medial shoulder, and thus more than two clamp-receiving portions, each potentially including one or more clamp assemblies therein.

Referring again to the illustrated embodiment, when the first and second clamp assemblies 106, 108 rotate with respect to the outer sleeve 104 (as by rotation of the drill pipe 102), the axial wear member 232 of the first clamp assembly 106 and/or the axial wear member 230 of the second clamp assembly 108 may slide against the corresponding axially-facing surface 1002, 1004 of the medial shoulder 1000. Which (if any) of the clamp assemblies 106, 108 engages the shoulder 1000 may depend on a direction of an axial (e.g., drag) force incident on the outer sleeve 104.

As can also be seen in FIG. 10, the axial wear members 230, 232 do not include the recesses 234, 236 (see FIG. 2). Rather, the bolts 241, which are not visible in FIG. 10, may be received into counter-sunk holes formed in the axial wear members 230, 232, thus preventing the bolts 241 from engaging adjacent structures in the same manner as the recesses 234, 236. This counter-sunk hole embodiment may be applied with any of the embodiments described herein.

Figure 11:
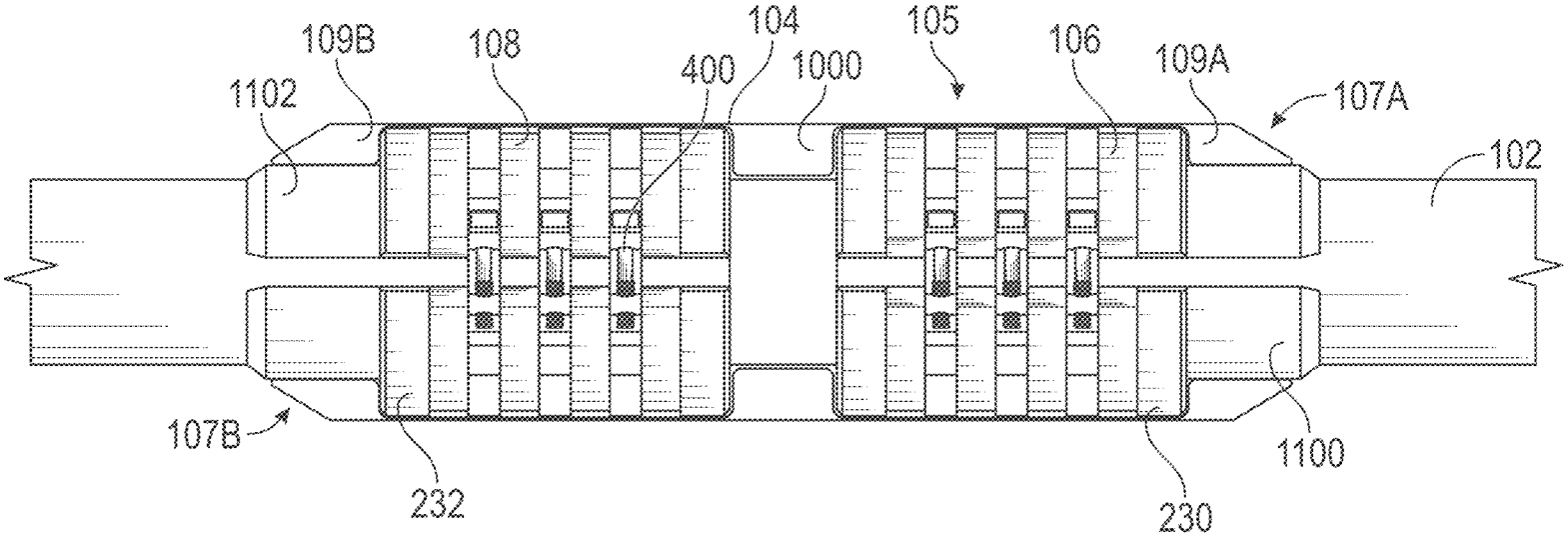
FIG. 11 illustrates a side view of another embodiment of the torque reducer.
Figure 12:
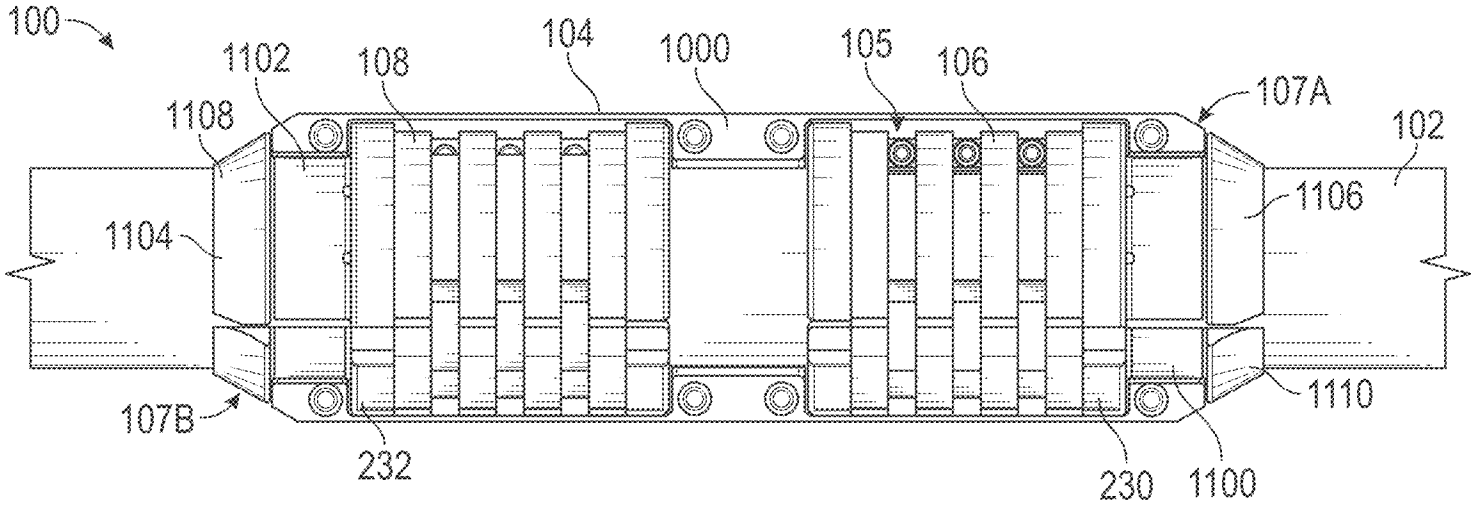
FIG. 12 illustrates a side view of another embodiment of the torque reducer.
Figure 13:
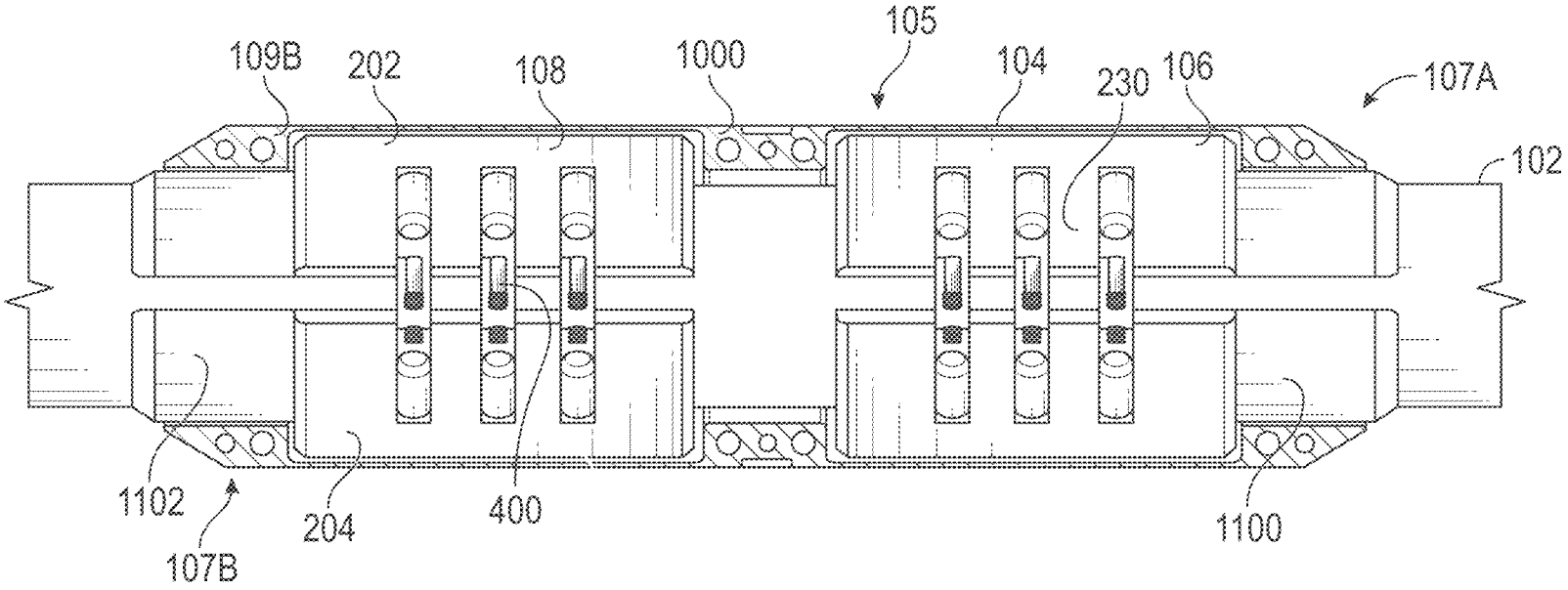
FIG. 13 illustrates a side view of another embodiment of the torque reducer.

FIGS. 11, 12, and 13 each illustrate a side view of another embodiment of the torque reducer 100. In these embodiments, extensions 1100, 1102 may extend axially from one of the axial wear members 230, 232 of each of the clamp assemblies 106, 108. The extension 1100, 1102 may be integrally formed as part of the axial wear members 230, 232 or may be a separate piece that is connected thereto. As shown, the extensions 1100, 1102 may be configured to fit radially between the outer sleeve 104 and the drill pipe 102. In particular, the extensions 1100, 1102 may be configured to fit between the end regions 107A, 107B, although, in other embodiments, at least one extension could be positioned between the shoulder 1000 (where provided) and the drill pipe 102. In embodiments including a single clamp assembly (i.e., spanning the entirety of the clamp-receiving region 105 of the outer sleeve 104), the single clamp assembly may include two such extensions 1100, 1102, one extending axially from each of its axial wear members 230, 232.

The outer sleeve 104 may rotate relative to the drill pipe 102 and clamp assemblies 106, 108, while an inner surface of the end regions 107A, 107B thereof engages the extensions 1100, 1102. The extensions 1100, 1102 may thus be made of a low-friction, wear-resistant material, similar to or the same as, the axial wear members 230, 232. The extensions 1100, 1102 may be sized to extend all or a portion of the axial length of the end regions 107A, 107B, such that the axial ends of the extensions 1100, 1102 and the outer sleeve 104 are aligned. In other embodiments, the extensions 1100, 1102 may be shorter, and the ends thereof may be within the outer sleeve 104. In still other embodiments, such as, for example, the embodiment of FIG. 12, the extensions 1100, 1102 may extend axially past the ends of, and thus outwards of, the outer sleeve 104.

In the specific, illustrated embodiment, the extensions 1100, 1102 may each include an outboard shoulder 1104, 1106. The shoulders 1104, 1106 may be integral with the remainder of the extensions 1100, 1102, being formed by the extensions 1100, 1102 extending radially outward. The outboard shoulders 1104, 1106 may be formed so that the axial ends of the outer sleeve 104 may bear upon the outboard shoulders 1104, 1106 when an axial load is applied to the outer sleeve 104. Engagement of the outer sleeve 104 with the outboard shoulder(s) 1104, 1106 may be contemporaneous with rotation of the outer sleeve 104, and thus the outboard shoulders 1104, 1106 may provide for a relatively low-friction, wear-resistant interaction therebetween. An outer surface 1108, 1110 of the outboard shoulders 1104, 1106 may be tapered so as to provide a smooth transition from the drill pipe 102 outwards to the outer surface of the outer sleeve 104 as proceeding axially along the drill pipe 102.

Figure 14:
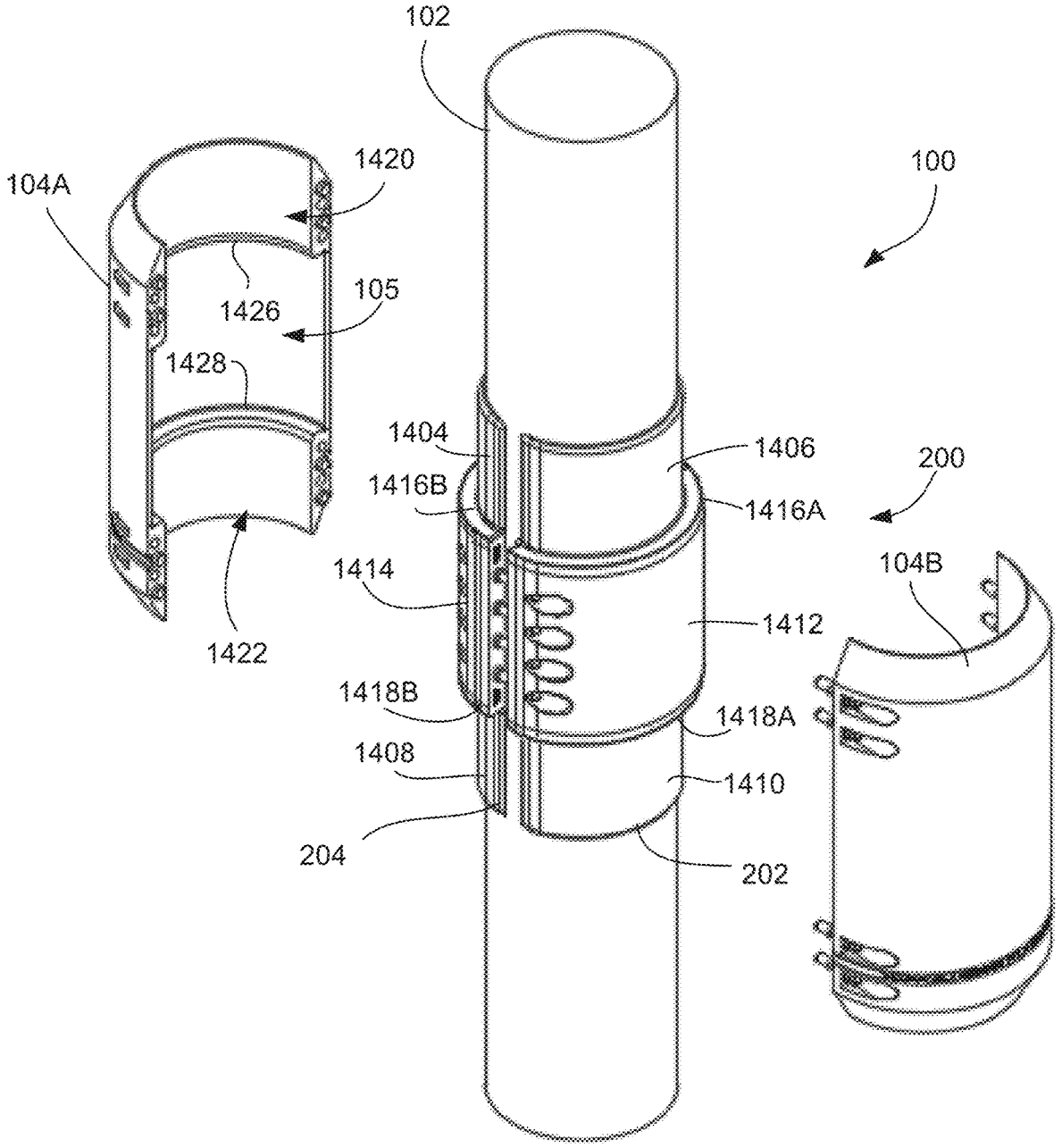
FIG. 14 illustrates a perspective, exploded view of yet another embodiment of the torque reducer installed on a drill pipe.

FIG. 14 illustrates a perspective, exploded view of the torque-reducer 100, according to another embodiment. The torque reducer 100 may include the clamp assembly 200 having the first and second arcuate clamp segments 202, 204, as discussed above. Similar to the embodiment of FIG. 4, the clamp assembly 200 may be generally continuous in an axial direction, as shown. Additionally, the clamp segments 202, 204 may be received separately around at least a portion of the drill pipe 102, and then the circumferential ends thereof may be fastened or otherwise connected together, as will be described in greater detail below Each of the clamp segments 202, 204 may each include a first extension 1404, 1406 and a second extension 1408, 1410, which extend in opposite axial directions from opposite axial ends of a central body 1412, 1414 of the clamp segments 202, 204, respectively. The extensions 1404-1410 may have a reduced thickness (radial dimension) in comparison to the central bodies 1412, 1414. Accordingly, axially-facing shoulders 1416A, 1416B, 1418A, 1418B may be defined at transitions between the extensions 1404-1410 and the central bodies 1412, 1414, e.g., where the extensions 1404-1410 meet the central body 1412, 1414. This may also be referred to as the central bodies 1412, 1414 and the extensions 1404-1410 together defining the shoulders 1416, 1418.

The outer sleeve 104 may be received around the segments 202, 204, such that an inner diameter surface thereof slides against an outer diameter surface of the segments 202, 204, as will be described in greater detail below. In particular, the outer sleeve 104 (including the two outer sleeve segments 104A, 104B, as mentioned above) may define a clamp-receiving region 105 therein, which is shaped (e.g., dimensioned) and/or otherwise configured to receive the central bodies 1412, 1414 of the clamp segments 202, 204. Further, the outer sleeve 104 may define first and second extension-receiving regions 1420, 1422 therein, on either axial side of the clamp-receiving region 105. The extension-receiving regions 1420, 1422 may be sized to receive the first extensions 1404, 1406 and the second extensions 1408, 1410, respectively. For example, the extension-receiving regions 1420, 1422 may have a smaller diameter than the clamp-receiving region 105. Axially-facing shoulders 1426, 1428 may be defined at a transition between the extension-receiving regions 1420, 1422 and the clamp-receiving region 105 (e.g., where the regions 1420, 1422 meet the clamp-receiving region 1411, which may also be referred to as the shoulders 1426, 1428 being defined therebetween). The shoulders 1426, 1428 may be sized, positioned, formed, or otherwise configured to slidingly engage the axially-facing shoulders 1416A, 1416B, 1418A, 1418B of the clamp assembly 200, respectively. The shoulder-to-shoulder engagement may provide a thrust-bearing function, transmitting axial loads on the outer sleeve 104 to the clamp assembly 200, and then to the drill pipe 102 via the gripping force.

In an embodiment, the inner clamp assembly 200 may be at least partially made from a through-hardened (or hardenable) alloy steel such as a chromium/molybdenum steel or a nickel/chromium/molybdenum steel, examples of which include AISI 4130, 4140, 4330, and 4340. In an embodiment, the outer radial surface of the clamp assembly 200 (e.g., provided cooperatively by the clamp segments 202, 204), which may be in contact with the inner surface of the outer sleeve 104, may be case-hardened using a process such as boriding, boronitriding, boronizing, or the like, which may produce a relatively low-friction and high surface hardness on the outer radial surface of the clamp assembly 200.

In an embodiment, the inner radial surface of the clamp assembly 200 (e.g., provided cooperatively by the clamp segments 202, 204) may be made at least partially of a bare, uncoated steel. The inner surface of the clamp assembly 200 may contact the drill pipe 102, and may thus not call for a low-friction interface therewith, as the clamp assembly 200 is generally configured, once attached to the drill pipe 102, to be immovable with respect thereto. As such, higher friction may be provided by the bare, uncoated steel of the inner surface of the clamp assembly 200 to maintain the axial and rotational holding force, so as to resist slippage. In some embodiments, non-marking grip coatings may be applied to the inner surface of the clamp assembly 200 to enhance friction between the clamp assembly 200 and the drill pipe 102. For example, a diamond nanoparticle embedded coating may be applied to the clamp assembly 200. The clamp assembly 200 may thus be formed with an outer surface having low friction and high hardness (e.g., harder than the inner surface of the outer sleeve 104) and an inner surface with high frictional characteristics.

The outer sleeve 104 may be made at least partially from a lower hardness steel than the casing into which the torque reducer 100 is run. The outer diameter surface of the outer sleeve 104 (e.g., as provided cooperatively by the sleeve segments 104A, 104B) may not be case-hardened, for example. The outer surface of the outer sleeve 104 having a lower hardness than the casing may avoid damage to interior of the casing. The inner surface of the outer sleeve 104 (e.g., as provided cooperatively by the sleeve segments 104A, 104B) may be case hardened, e.g., plasma nitrided. The case hardening of the inner surface of the outer sleeve 104 may be configured to produce a lower hardness than the hardness of the outer radial surface of the clamp assembly 200. Because the inner surface of the outer sleeve 104 slides against the relatively harder outer surface of the clamp assembly 200, the nitrided layer of the interior of the outer sleeve 104 may wear more quickly than does the boride hardened layer on the outer radial surface of the clamp assembly 200. Accordingly, the outer sleeve 104 is generally configured to be consumable or sacrificial, relative to the casing and the clamp assembly 200, as the wear of the components may generally occur in the outer sleeve 104, which is softer on the inside than the outer surface of the clamp assembly 200, and softer on the outside than the casing.

Figure 15:
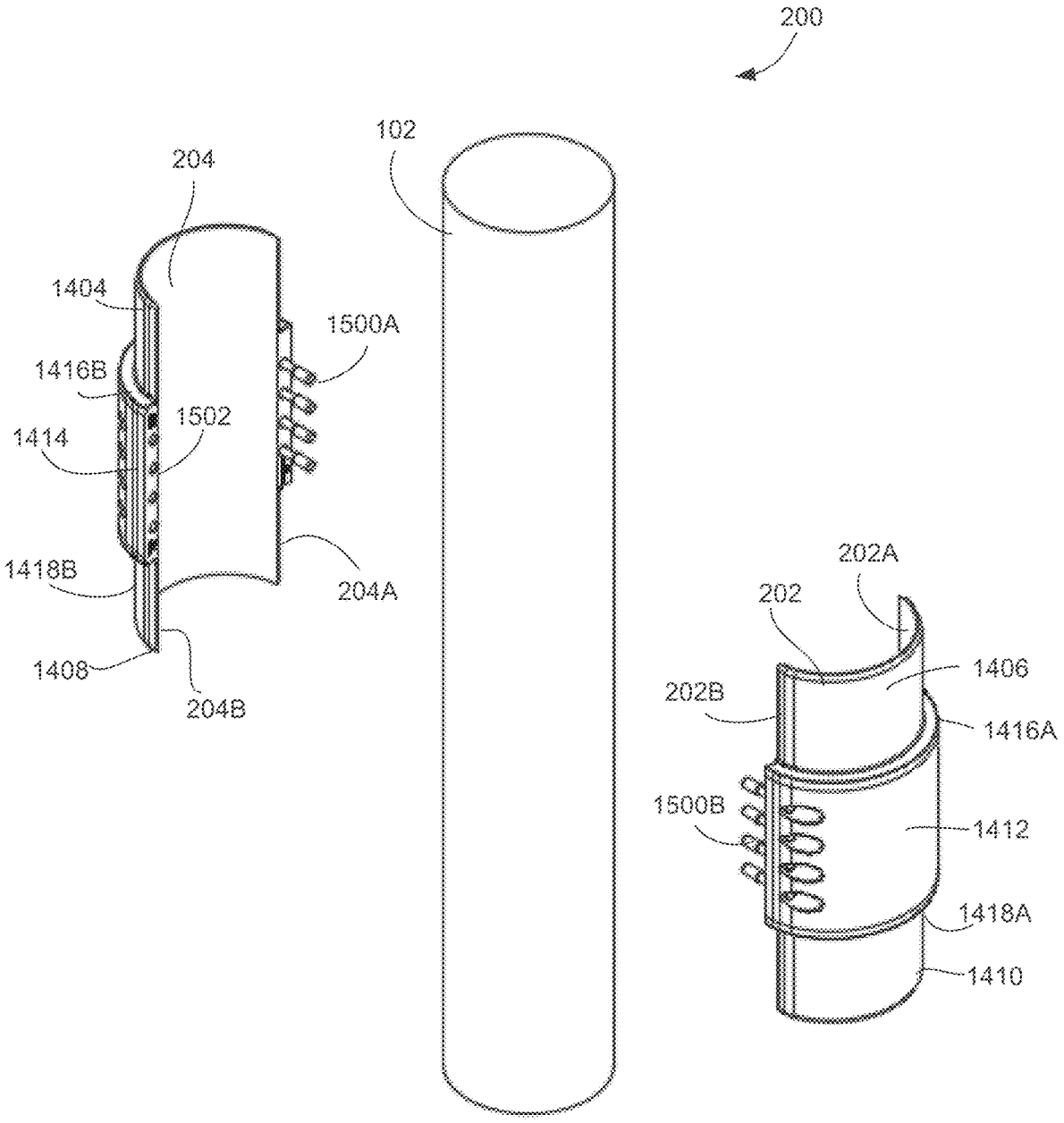
FIG. 15 illustrates a perspective, exploded view of a clamp assembly of the embodiment of FIG. 14, installed onto a drill pipe, according to an embodiment.

FIG. 15 illustrates a perspective, exploded view of the clamp assembly 200 of FIG. 14. As shown, the two clamp segments 202, 204 are received laterally onto the pipe 102. The circumferential ends 202A, 204A and 202B, 204B may then be connected together, thereby securing the clamp assembly 200 to the pipe 102. For example, the circumferential ends 202A, 202B and 204A, 204B of the clamp segments 202, 204 may initially be unconnected to one another, e.g., such that the clamp segments 202, 204 are not connected together before being received onto the tubular 102. Fasteners, such as bolts, 1500A, 1500B may be received through holes 1502 in one or more of the circumferential ends 202A, 202B, 204A, 204B, generally in a tangential orientation to the arcuate clamp segments 202, 204. Tightening the fasteners 1500 (e.g., by tightening a nut or rotating the bolts through threaded holes) may draw the circumferential ends 202A, 204A and 202B, 204B together, thereby securing the segments 202, 204 around the pipe 102 and producing the gripping force therebetween. In at least one embodiment, the holes 1502 may be formed in the central body 1412, 1414 of the segments 202, 204. The fasteners 1500 may be removed, e.g., by reversing such rotation, such that the fasteners 1500 may be considered to "releasably couple" the segments 202, 204 together.

Figure 16:
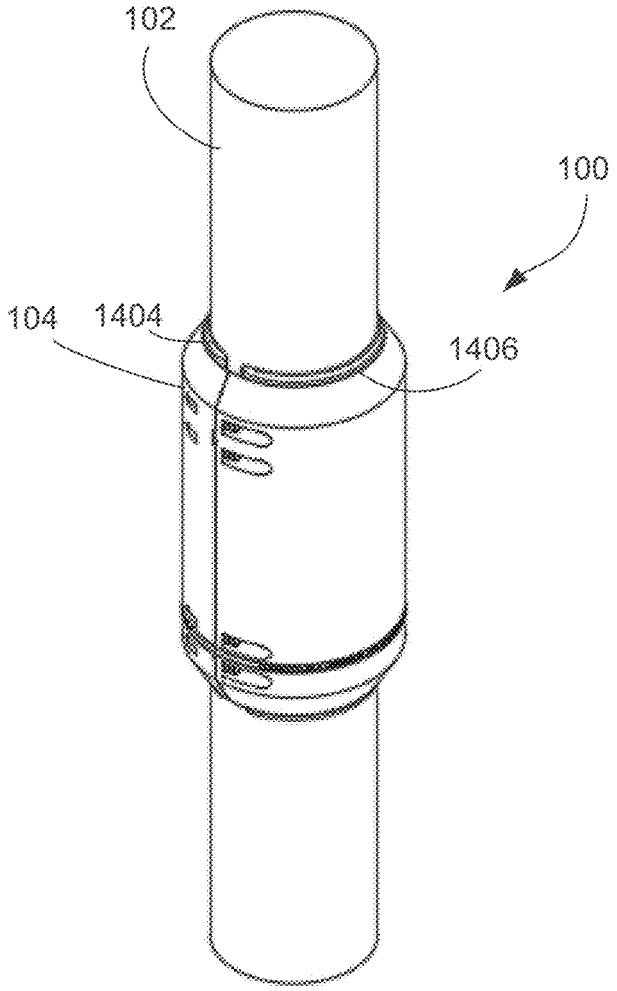
FIG. 16 illustrates a perspective view of the torque reducer of FIG. 14 installed on the drill pipe, according to an embodiment.

FIG. 16 illustrates a perspective view of the torque reducer 100 of FIGS. 14 and 15, assembled on the pipe 102, according to an embodiment. The circumferential end of the segments 104A, 104B (e.g., FIG. 14) of the outer sleeve 104 are secured together around the clamp assembly 200, such that the clamp assembly 200 (e.g., FIG. 15) resides radially between the drill pipe 102 and the outer sleeve 104. Further, the clamp assembly 200 and the drill pipe 102 are relatively rotatable, with the torque reducer 100 facilitating such rotation by providing a bearing-like functionality. The extensions 1404-1410, which are visible in FIG. 16 at the axial extends of the outer sleeve 104, and the shoulder-to-shoulder engagement at axially-facing shoulders 1416A, 1416B, 1418A, 1418B may between the clamp assembly 200 and the internal geometry of the outer sleeve 104, provide a thrust-bearing like functionality, which serves to facilitate the rotation between the outer sleeve 104 and the drill pipe 102, despite any axial loading of the outer sleeve 104. Accordingly, as shown in FIG. 16, the outer sleeve 104 may envelope the clamp assembly 200 therein.

Figure 17:
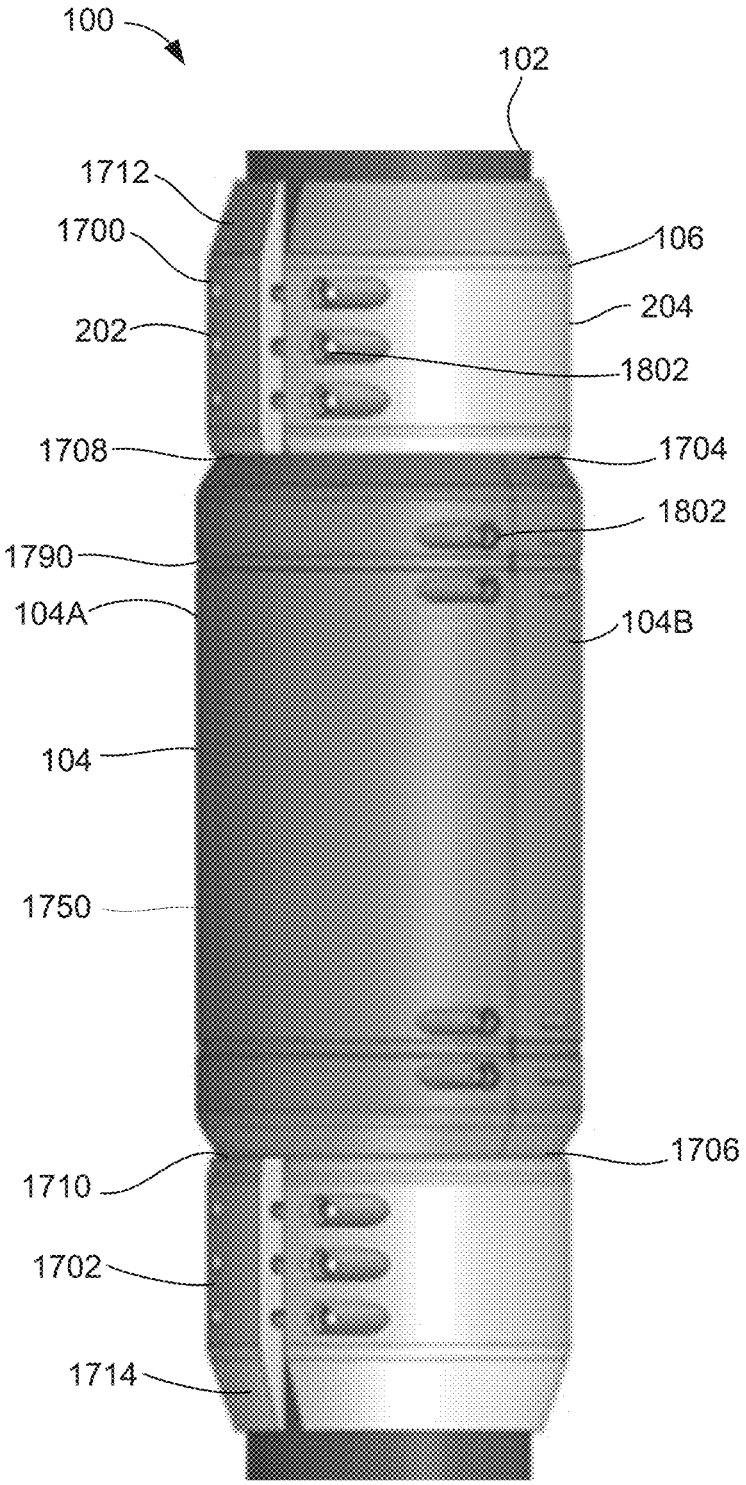
FIG. 17 illustrates a side view of the torque reducer 100 positioned on the tubular 102, according to another embodiment.
Figure 18:
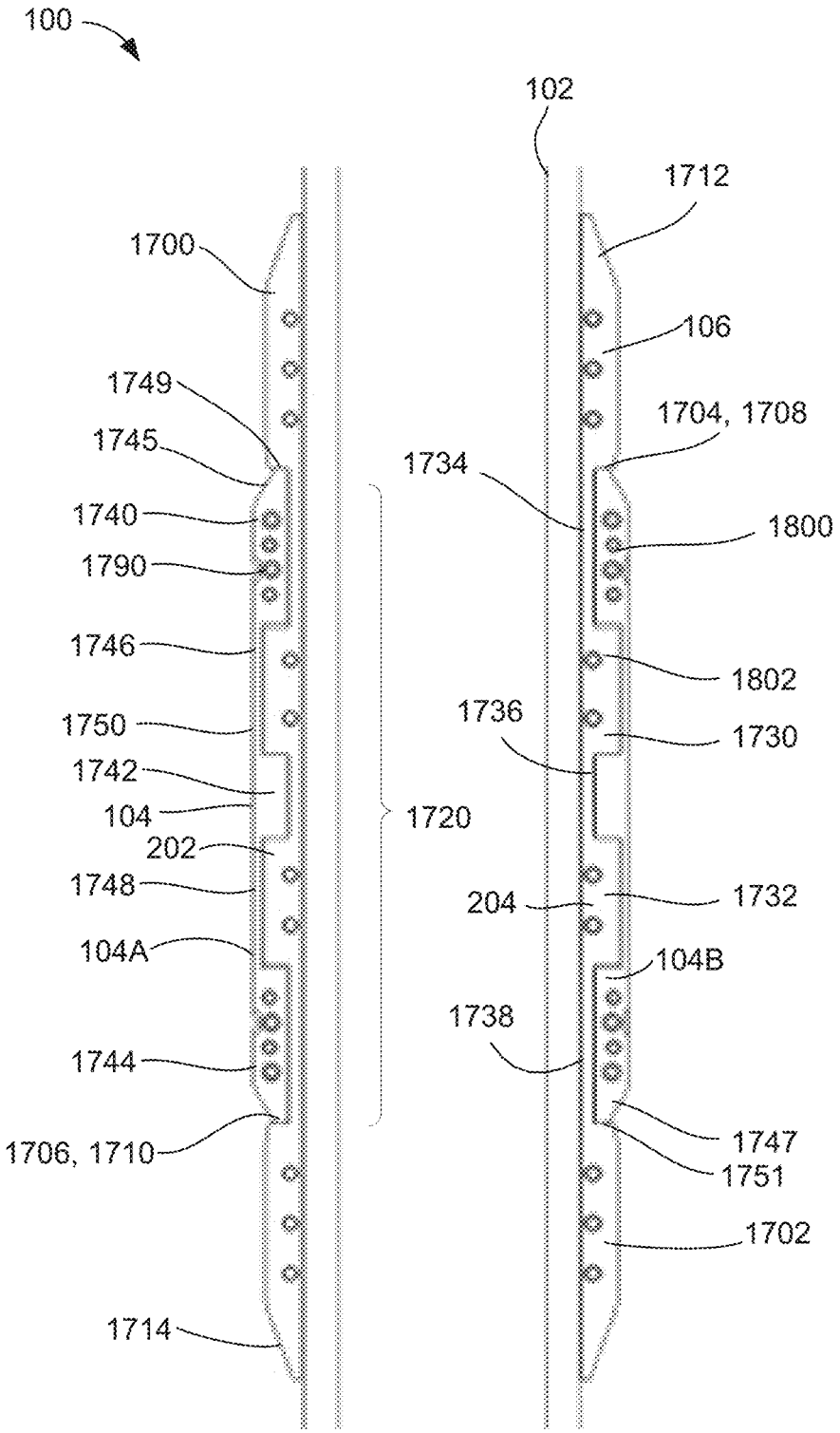
FIG. 18 illustrates a side, cross-sectional view of the torque reducer 100 of FIG. 17.

FIG. 17 illustrates a side view of the torque reducer 100 positioned on the tubular 102, according to another embodiment. FIG. 18 illustrates a side, cross-sectional view of the torque reducer 100 of FIG. 17. Referring to both FIGS. 17 and 18, as in the embodiments discussed above, the torque reducer 100 includes the outer sleeve 104 and the clamp assembly 106, with the outer sleeve 104 having outer sleeve segments 104A, 104B, and the clamp assembly 106 likewise having clamp segments 202, 204. The clamp segments 202, 204 may be connected together at their circumferential ends, so as to circumscribe and grip the tubular 102. The sleeve segments 104A, 104B may be received around the clamp assembly 106 and connected together, circumferential end to circumferential end, and thereby circumscribe the clamp assembly 106. The outer sleeve 104 may be configured to rotate relative to the clamp assembly 106, while the clamp assembly 106 may be secured against movement relative to the tubular 102.

In this embodiment, the clamp assembly 106 includes enlarged extensions 1700, 1702 at either axial end of the clamp assembly 106. The clamp segments 202, 204 may each form half-cylindrical bodies (or another fraction, e.g., if there are more than two clamp segments). The outer sleeve 104 may be received around the clamp assembly 106, axially between the enlarged extensions 1700, 1702, such that axial forces incident on the outer sleeve 104 are transmitted to the clamp assembly 106 via engagement between inboard facing axial ends 1704, 1706 of the outer sleeve 104 and shoulder surfaces 1708, 1710 of the enlarged extensions 1700, 1702, as will be described in greater detail below.

Furthermore, at least a portion 1712, 1714 of each of the enlarged extensions 1700, 1702 may be tapered, as proceeding in an axial direction, away from one another, thereby providing a conical guide surface for the extensions 1700, 1702. In an embodiment, the enlarged extensions 1700, 1702 may be tapered into a relatively thin shoulder on the outboard side thereof. Since the clamp assembly 106 may be directly positioned on the tubular 102, this may provide a small shoulder profile for the torque reducer 100, which reduces the potential for the torque reducer 100 to catch on wellbore restrictions, other equipment, etc., while being moved in the well.

Referring specifically now to FIG. 18, the clamp segment 202 may include a central body 1720 extending axially between the extensions 1700, 1702, radially between the tubular 102 and the outer sleeve 104. The central body 1720 may include one or more recesses and one or more shoulders. In the illustrated embodiment, the central body 1720 includes two protrusions 1730, 1732 and three recesses 1734, 1736, 1738, which are interleaved, such that the recesses 1734, 1736, 1738 separate the protrusions 1730, 1732 axially apart. Although two pairs are shown, any number of protrusions and recesses may be formed. The protrusions 1730, 1732 defined areas where the central body 1720 protrudes radially outward from the recesses 1734, 1736, 1738 such that the recesses 1734, 1736 defined areas that are thin, radially, as compared to the protrusions s 1730, 1732. The axial span and radial thickness of the protrusions 1730, 1732 and the recesses 1734, 1736, 1738 may be uniform or may differ.

The sleeve segment 104A may also include one or more protrusions alternating with one or more recesses. In particular, in this embodiment, the sleeve segment 104A includes three protrusions 1740, 1742, 1744 and two recesses 1746, 1748, with the recesses 1746, 1748 separating the protrusions 1740, 1742, 1744, and the protrusions 1740, 1742, 1744 representing areas of increased radial thickness, where the sleeve segment 104A extends radially inwards. The outer diameter surface 1750 of the outer sleeve 104 may be generally uniform. At least a portion 1745, 1747 of the protrusions 1740, 1744 may be tapered, such that ends 1749, 1751 of the protrusions 1740 are relatively small and, e.g., obscured from forming an exposed radial profile at the enlarged extensions 1700, 1702.

The clamp segment 204 may be substantially similar (e.g., the same as) the clamp segment 202, and the sleeve segment 104B may be substantially similar to (e.g., the same as) the sleeve segment 104A, such that, when assembled the internal profiles of recesses, protrusions, and shoulders discussed above are generally annular. More particularly, the recesses 1734, 1736, 1738 of the clamp assembly 106 may be sized and configured to receive the protrusions 1740, 1742, 1744 of the outer sleeve 104. Likewise, the recesses 1746, 1748 of the outer sleeve 104 may be sized and configured to receive the protrusions 1730, 1732 of the clamp assembly 106. The protrusions 1740, 1742, 1744 may engage and bear upon the protrusion 1730, 1732, and thereby transmit axial and radial loads thereto. The outboard-most protrusions 1740 and 1744 may also be able to bear against the enlarged extensions 1700, 1702, as noted above.

Accordingly, three load surfaces are provided between the outer sleeve 104 and the clamp assembly 106 to transmit force in either axial direction. That is, in the presence of downward axial loads, the protrusion 1740 bears upon the shoulder 1730, the protrusion 1742 bears upon the shoulder 1732, and the protrusion 1744 bears upon the enlarged extension 1702. The load engagements in the reverse axial direction (upwards), result in the protrusion 1744 bearing against the shoulder 1732, the protrusion 1742 bearing against the shoulder 1730, and the protrusion 1740 bearing against the enlarged extension 1700.

Referring again additionally to FIG. 17, the outer sleeve 104 may also include a wear band 1790, e.g., a groove formed in the outer diameter surface 1750 of the outer sleeve 104, which may show the extent to which the material has been worn off of the outer sleeve 104. Moreover, as mentioned above, fasteners (e.g., bolts) 1800 may be employed to secure the clamp segments 202, 204 together, and may be tightened to provide the radial-inward gripping force onto the tubular. Specifically, bolts 1800 may be secured through holes formed in the enlarged extensions 1700, 1702, as seen in FIG. 17, and/or in the protrusions 1730, 1732 formed in the central body 1720, as seen in FIG. 18. Similarly, fasteners (e.g., bolts) 1802 may secure the outer sleeve segments 104A, 104B together, while permitting rotation.

Figure 19A:
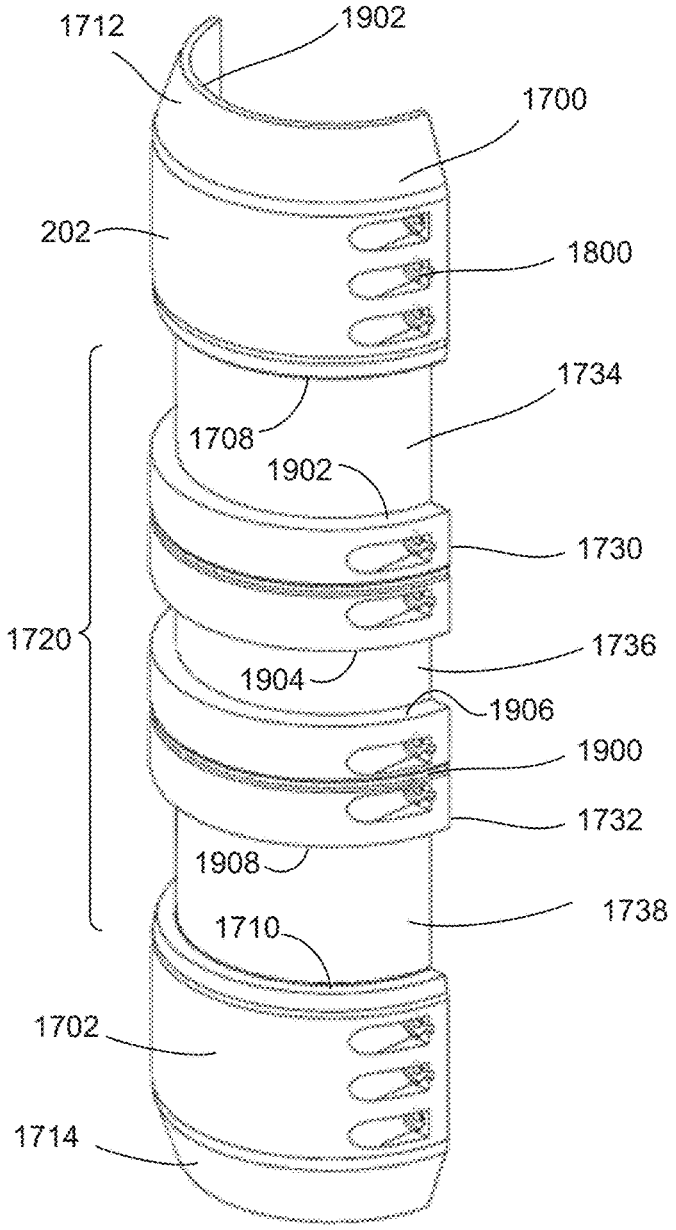
FIG. 19A illustrates a perspective view of the clamp segment of FIG. 17, according to an embodiment.

FIG. 19A illustrates a perspective view of the clamp segment 202 of FIG. 17, according to an embodiment. As discussed above, the clamp segment 202 may include the enlarged extensions 1700, 1702 on either axial end, each having tapered portions 1712, 1714, respectively. The central body 1720 extends between and is defined on either axial side by the enlarged extensions 1700, 1702. The central body 1720 defines the protrusions 1730, 1732 and the recesses 1734, 1736, 1738 for creating load-transferring surfaces that engage complementary surfaces on the outer sleeve 104, as discussed above. Additionally, the protrusions 1730, 1732 may define wear bands 1900, which may provide a visual indication of the amount of material that is worn off of the central body 1720 during use. Each of the protrusions 1730, 1732 may define a pair of axially-facing shoulder surfaces. For example, the protrusion 1730 may define shoulder surfaces 1902, 1904, and the protrusion 1732 may define shoulder surfaces 1906, 1908. The shoulder surfaces 1902-1908 may engage surfaces of the sleeve 106, as will be described in greater detail below.

Figure 19B:
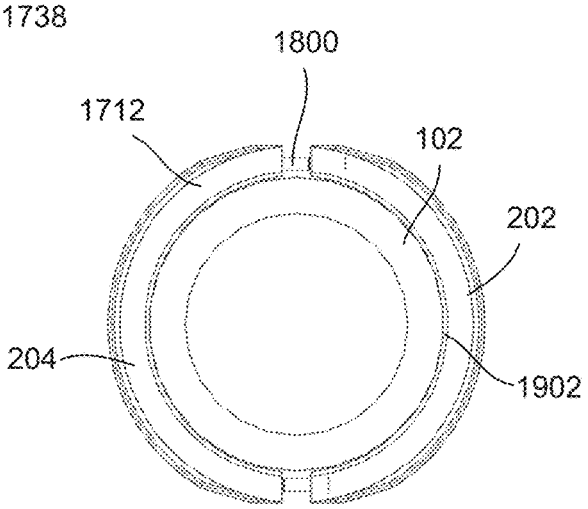
FIG. 19B illustrates an end view of clamp assembly positioned on the tubular, according to an embodiment.

FIG. 19B illustrates an end view of clamp assembly 106 positioned on the tubular 102, according to an embodiment. Specifically, the clamp segments 202, 204 are shown, fastened together via the fasteners 1800 and secured around the tubular 102. As is visible in both FIGS. 19A and 19B, the tapered portion 1712, such that the shoulder surfaces 1902 is relatively thin (e.g., small in radial dimension). This axial surface 1902 may be tapered down from the thickness of the enlarged extension 1700, such that only a small profile, extending generally in the straight radial direction is exposed, which may reduce a potential for the torque reducer 100 to catch on surrounding structures within the wellbore as the drillstring is lowered into or withdrawn from the wellbore.

Figure 20:
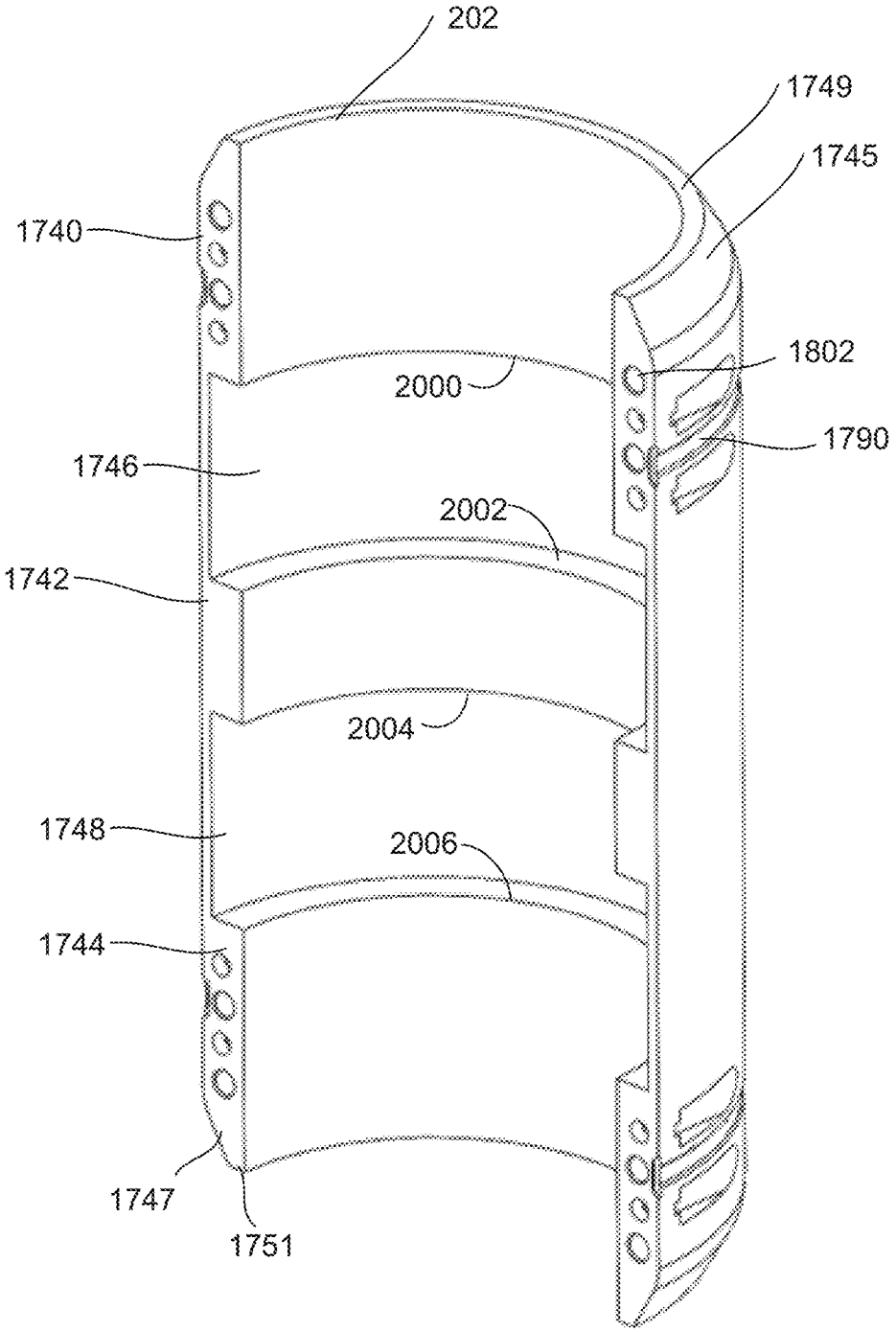
FIG. 20 illustrates a perspective view of the sleeve segment of FIGS. 17 and 18, according to an embodiment.

FIG. 20 illustrates a perspective view of the sleeve segment 104B of FIGS. 17 and 18, according to an embodiment. As shown, the sleeve segment 104B includes the radially inward protrusions 1740, 1742, 1744, with the recesses 1746, 1748 positioned therebetween. Further, the protrusions 1740 and 1744 include the tapered portions 1745, 1747, which terminate in the relatively small axial end surfaces 1749, 1751, which may bear against the enlarged extensions 1700, 1702 (e.g., FIG. 17), so as to avoid providing an exposed, radial surface that might catch with objects in the well.

As shown in FIG. 20, the sleeve segment 104B includes axially-facing shoulder surfaces 2000, 2002, 2004, 2006 formed on the respective protrusions 1740, 1742, 1744. In particular, the surface 2000 may be an in-board facing shoulder surface of the protrusion 1740, and the surface 2006 may be an inboard-facing surface of the protrusion 1744. When the outer sleeve 104 is installed on the clamp assembly 102, the aforementioned load-transferring surface engagement is provided. Specifically, the shoulder surface 2000 may engage and be permitted to slide with respect to the shoulder surface 1902, the shoulder surface 2002 may engage and be permitted to slide with respect to the shoulder surface 1904, the shoulder surface 2004 may engage and be permitted to slide with respect to the shoulder surface 1906, and the shoulder surface 2006 may engage and be permitted to slide with respect to the shoulder surface 1908. Further, the ends 1749, 1751 of the outer sleeve 106 may engage and slide with respect to the inboard ends 1708, 1710 of the enlarged extensions 1700, 1702, respectively. Each such sliding engagement may represent a potential axial-load transfer interface between the outer sleeve 106 and the clamp assembly 104.

Figure 21:
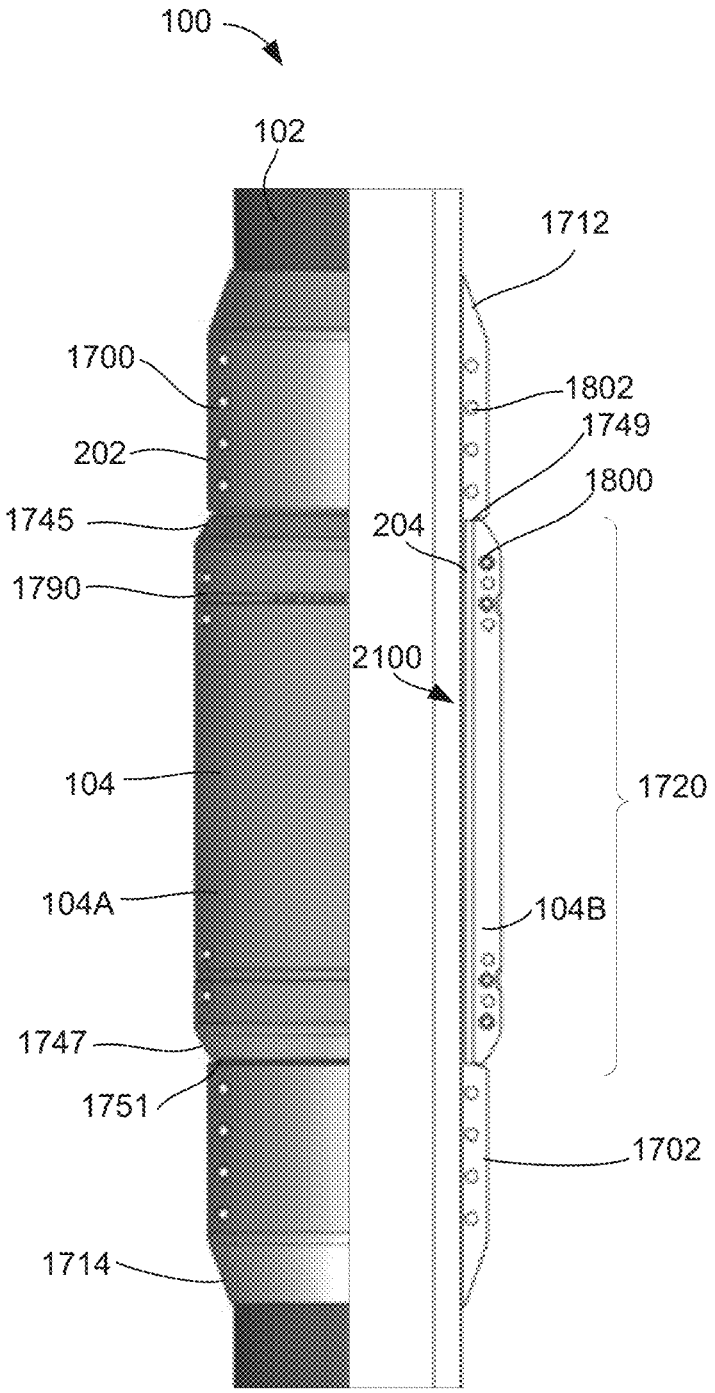
FIG. 21 illustrates a half-sectional view of another embodiment of the torque reducer.

FIG. 21 illustrates a half-sectional view of another embodiment of the torque reducer 100. This embodiment may be similar to the embodiments of FIGS. 16-20 discussed above, including the enlarged extensions 1700, 1702 with the tapered portions 1712, 1714. However, in this embodiment, the central body 1720 of the clamp assembly 106 may not include the multiple shoulders and recesses, but may include a single, sleeve-receiving recess 2100. Likewise, the outer sleeve 104 may omit the shoulders and recesses, and may be formed of a substantially cylindrical body. The outer sleeve 104, in this embodiment, may include the tapered portions 1745, 1747, such that the end surfaces 1749, 1751 thereof are protected by engagement with the enlarged extensions 1700, 1702. Moreover, axial load may be transferred from the outer sleeve 104 to the clamp assembly 106 via the engagement between the end surfaces 1749 of the outer sleeve and 1751 of the inner clamp, while the outer sleeve 104 is permitted to rotate relative to the clamp assembly 106 and the tubular 102.

Figure 22:
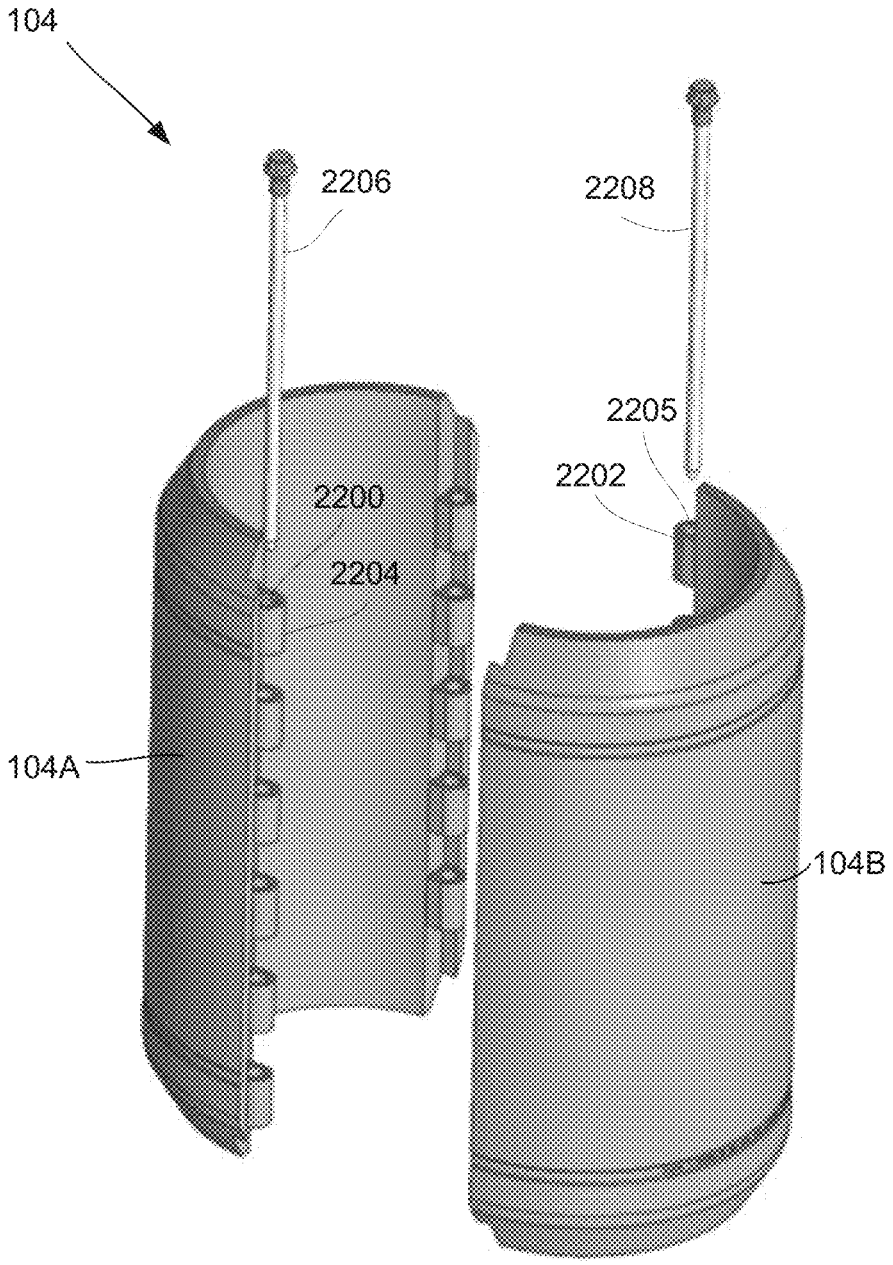
FIG. 22 illustrates an exploded, perspective view of the outer sleeve, according to another embodiment.

FIG. 22 illustrates an exploded, perspective view of the outer sleeve 104, according to another embodiment. In this embodiment, the sleeve segments 104A, 104B each include circumferentially-extending knuckles 2200, 2202, which may extend from both circumferential ends of each of the sleeve segments 104A, 104B, and which may be interleaved together. The knuckles 2200, 2202 each have holes 2204, 2205 therethrough. Once aligned, the holes 2204, 2205 may receive a pin 2206, 2208 therethrough, which may serve to hold the sleeve segments 104A, 104B together on either circumferential side. This may provide a rigid connection between the two sleeve segments 104A, 104B, while permitting the outer sleeve 104 to rotate freely around the clamp assembly 106 (e.g., FIG. 17).

Figure 23:
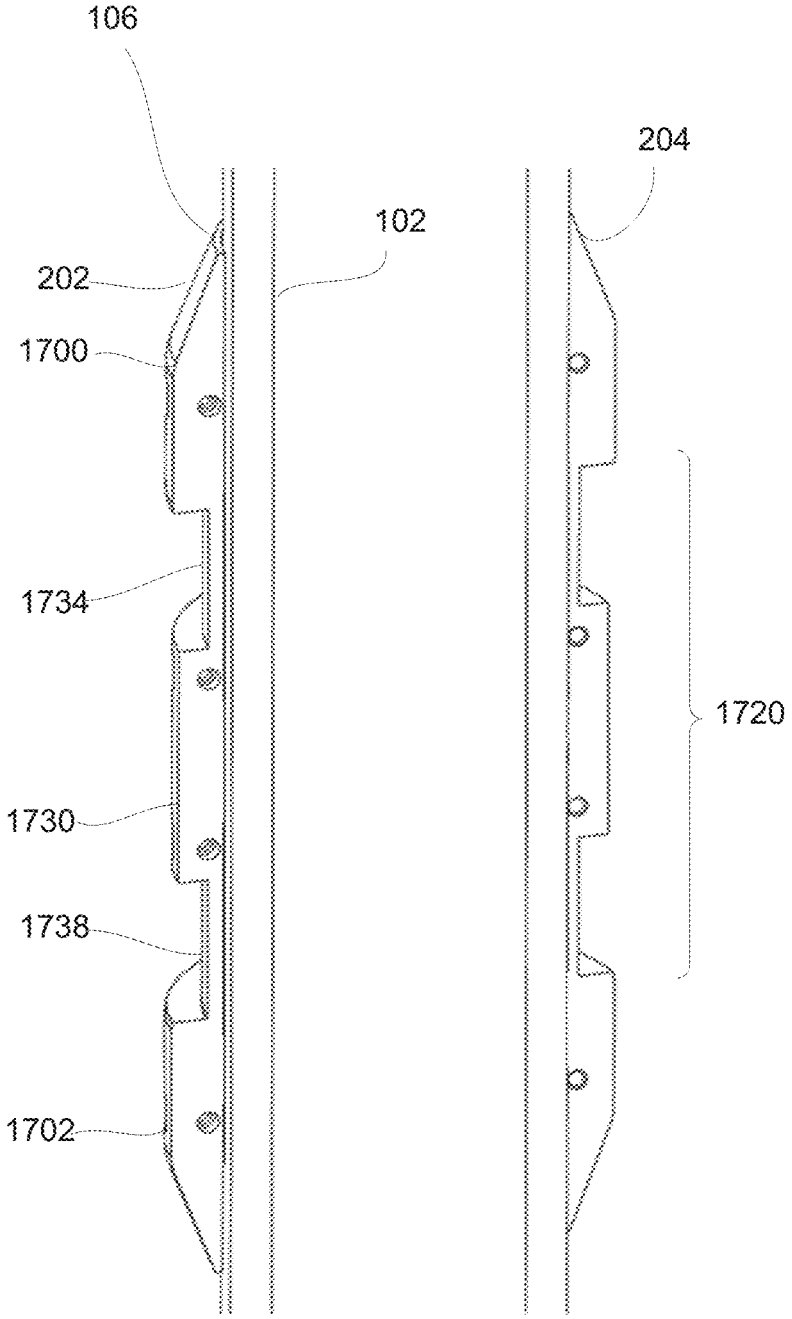
FIG. 23 illustrates a side, cross-sectional view of another embodiment of the clamp assembly of the torque reducer.

FIG. 23 illustrates a side, cross-sectional view of another embodiment of the clamp assembly 106 of the torque reducer 100. This embodiment may be similar to the embodiments of FIGS. 17-20, with the clamp assembly 106 including the clamp segments 202, 204 having the enlarged extensions 1700, 1702 and the central body 1720 extending therebetween and defining recesses 1734, 1738 and the protrusion 1730. The recess 1736 (e.g., FIG. 18) is omitted in this embodiment, although it may be present in some embodiments.

Figure 24A:
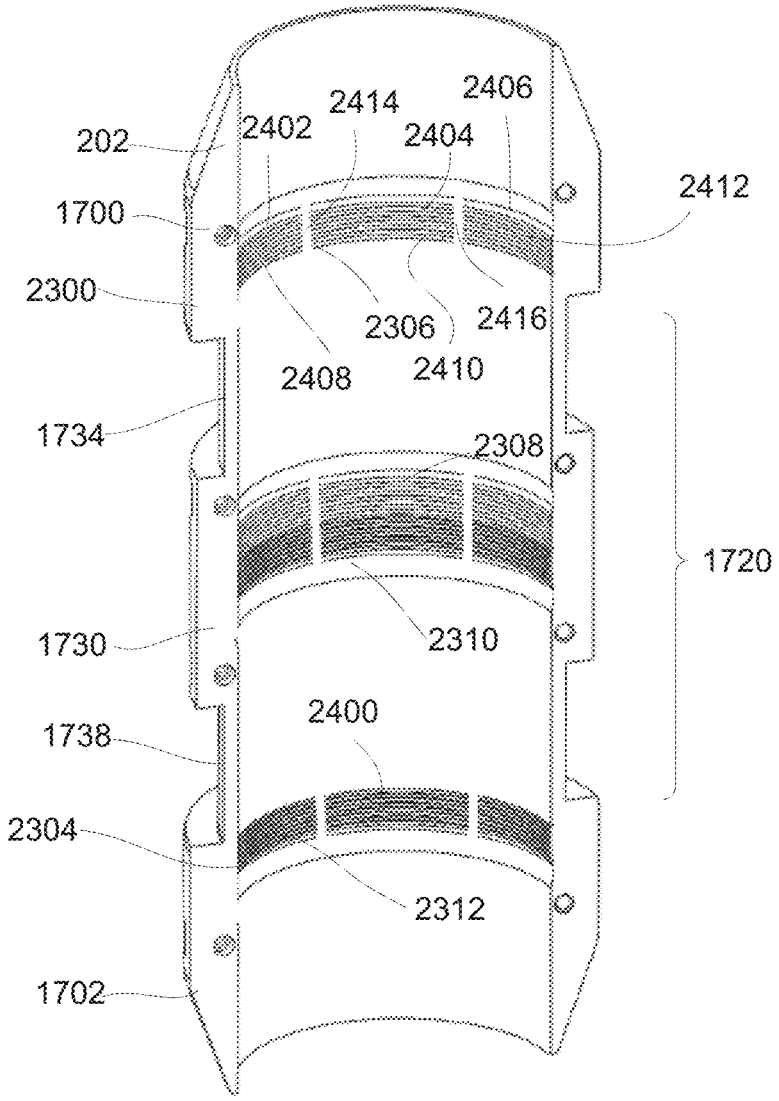
FIG. 24A illustrates a perspective view of an interior of one of the clamp segments of the embodiment of the clamp assembly of FIG. 23.

FIG. 24A illustrates a perspective view of an interior of one of the clamp segments 202 of the embodiment of the clamp assembly 106 of FIG. 23. Additionally, the clamp assembly 106 may include pockets (visible in FIGS. 24A, 25A, and 25B and labeled therein as 2300, 2302, 2304), in which lock inserts (four are shown: 2306, 2308, 2310, 2312) are received. Each of the inserts 2306-2312 may be formed as two or more arcuate segments. Further, the insert 2306 may be received in the pocket 2300, the inserts 2308, 2310 may be received in the pocket 2302, and the insert 2312 may be received in the pocket 2304.

The pockets 2300-2304 may be wedge-shaped and may be positioned in the respective radially-enlarged portions of the clamp segments 202, 204, e.g., in the enlarged extensions 1700, 1702 and the shoulder 1730. In the illustrated embodiment, the pockets 2300, 2304 each define a single wedge, and the pocket 2302 defines two wedges, one tapering in each axial direction. Likewise, the inserts 2306-2312 may have a wedge-shaped exterior surface that is configured to slide along the inner surface of the wedge-shaped pockets 2300-2304. Accordingly, relative axial movement of the clamp segments 202, 204 and the inserts 2306-2312 may move the inserts 2306-2312 radially toward the tubular 102. Specifically, movement of the clamp segments 202, 204 downward drives the inserts 2306, 2308 into the tubular 102, while movement of the clamp segments 202, 204 upward drives the inserts 2310, 2312 into the tubular 102.

The inserts 2306-2312 may be sized such that, even in the farthest radially outward, or "retracted" position, the inserts 2306-2312 maintain a radial gap between the tubular 102 and the clamp segments 202, 204. In some cases, flexing, movement, etc., may permit part of one or both of the clamp segments 202, 204 to contact the tubular 102, but the inserts 2306-2312 may generally provide an annular radial gap between at least a portion of the clamp segments 202, 204 and the tubular 102. Thus, connecting the clamp segments 202, 204 together around the tubular 102 may provide an initial, radial-inward gripping force by compressing the inserts 2306-2312 between the clamp segments 202, 204 and the tubular 102. Axially-directed loads on the clamp segments 202, 204 may force the clamp segments 202, 204 in the axial direction, which in turn drives at least some of the inserts 2306-2312 into tighter gripping engagement with the tubular 102, thereby resisting displacement of the clamp assembly 106 relative to the tubular 102.

The clamp segment 204 may be substantially similar (e.g., the same). In this view, gripping surfaces 2400 of the inserts 2306-2312 are visible. The gripping surface 2400 is configured to engage the tubular 102 (e.g., FIG. 17). The gripping surface 2400 may be or include a grip coating (e.g., a grit) and/or teeth. In some embodiments, a non-marking grip coating, for example, a diamond nanoparticle embedded coating, may be applied to inserts 2306-2312.

As shown, the pockets 2300-2304 may each be partitioned into smaller, arcuate pockets, e.g., pockets 2402, 2404, 2406 as indicated for the pocket 2300. The inserts 2306-2312 may likewise be segmented into insert segments, e.g., insert segments 2408, 2410, 2412 for the insert 2302. Axially-extending shoulders 2414, 2416 are formed between adjacent pockets 2402-2408.

The insert segments 2408-2412 may be arcuate in shape, to match the curvature of the outer diameter surface of the tubular 102, and may be configured to bite into the tubular 102 when the clamp segments 202, 204 force the inserts 2306-2312 radially inwards. In at least some embodiments, at least a portion of the gripping surface 2400 may extend at least partially in an axial direction, providing a frictional contact surface with an axial component. When the gripping surface 2400 bites into the tubular 102, the gripping surface 2400 may be at least partially embedded into the tubular 102, and may thus provide transmission of axially and/or circumferentially-directed loads. In such embodiments, the gripping surface 2400 and inserts 2306-2312 may permit the clamp assembly 104 to resist rotation and axial movement with respect to the tubular 102.

Figure 25B:
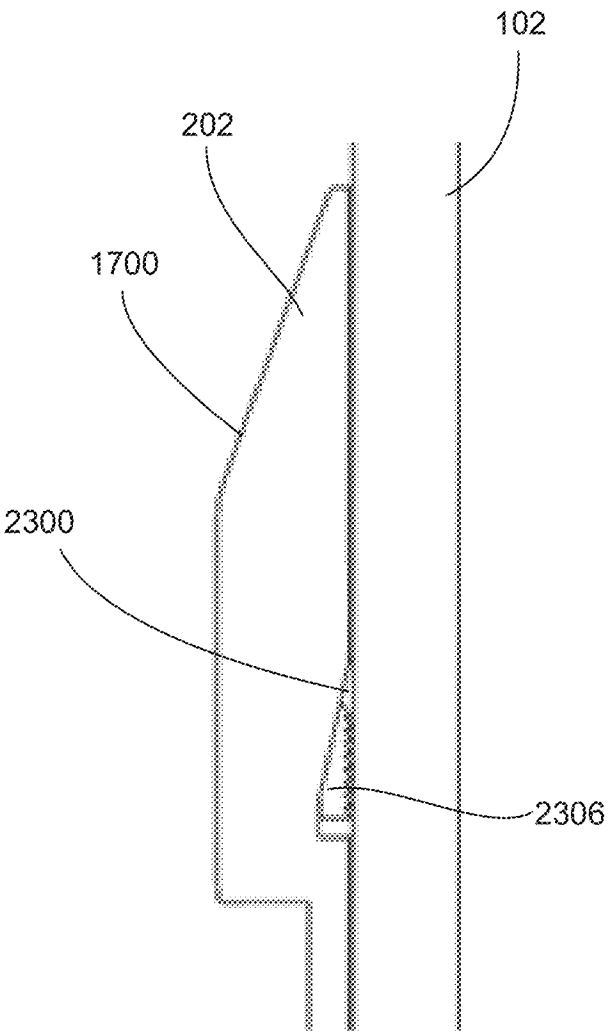
FIGS. 25A and 25B illustrate two partial views of the clamp segment of the embodiment of FIG. 23 engaging the tubular.
Figure 25A:
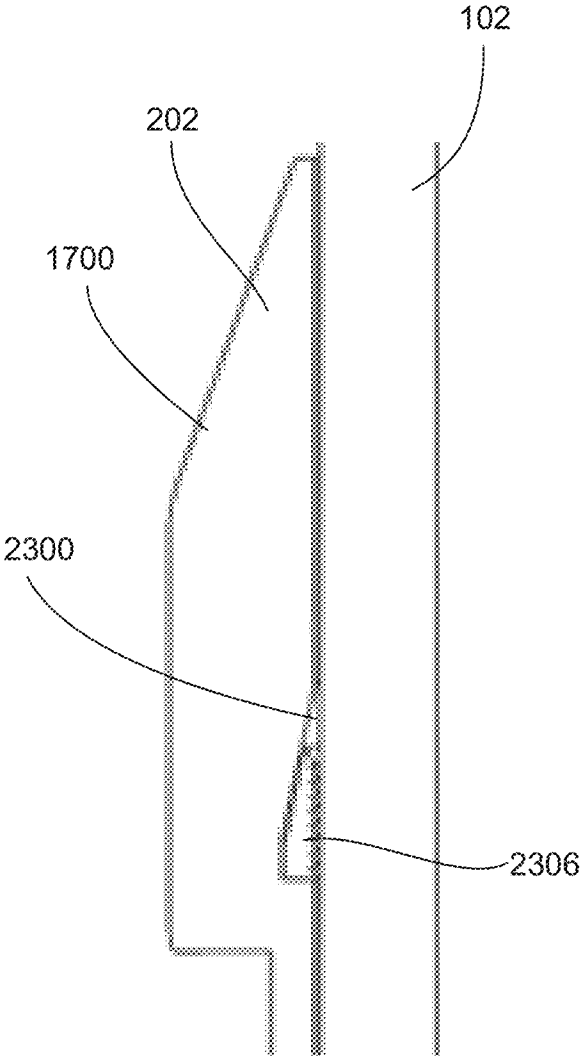
Figure 26:
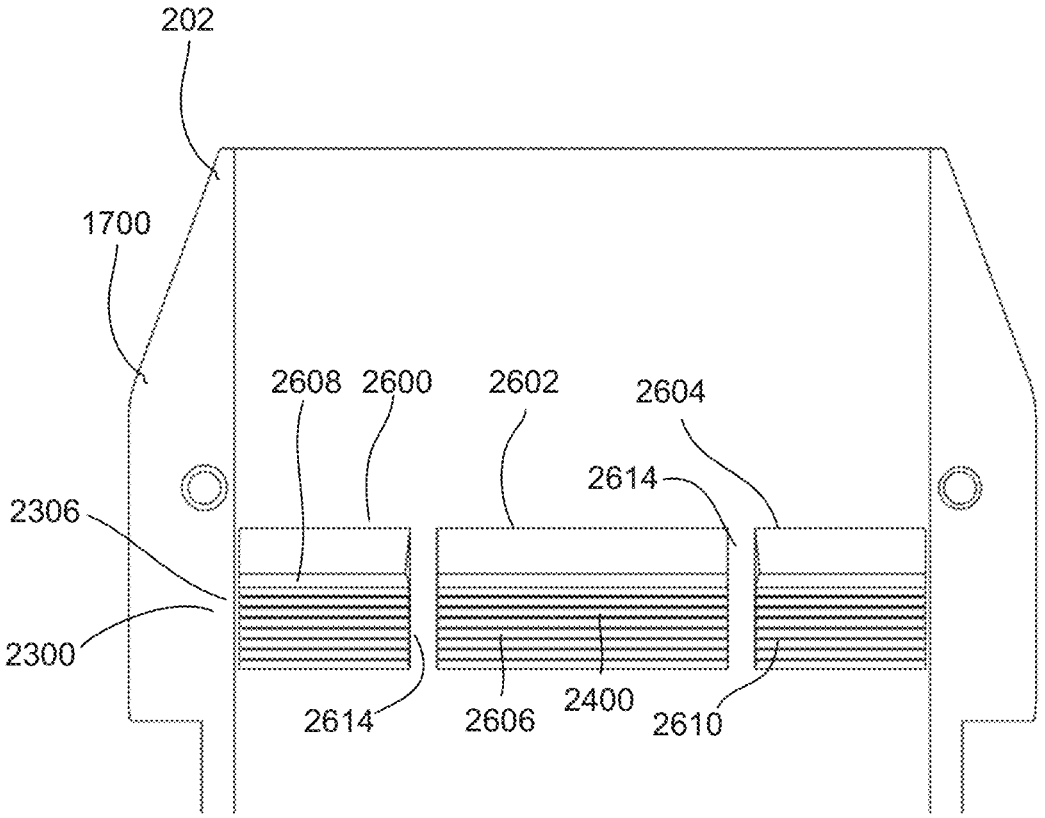
FIG. 26 illustrates a partial, cross-sectional view of another embodiment of the clamp assembly.

The provision of arcuate insert segments 2408-2412 between the shoulders 2414, 2416 may provide for increased torque transmission between the insert segments 2408-2412 and the clamp segment 202, such that the clamp segment 202 resists rotation around the tubular 102, when the insert segments 2408-2412 are engaged with the tubular 102 (e.g., FIG. 25A). Specifically, the insert segments 2408-2412 may slide along the tapered surface of the pockets 2400-2614, substantially as discussed above, and may transmit circumferential loads (torque) between the tubular 102 and the shoulders 2612, 2614. As noted above, at least a portion of the marking structure 2400 may be at least partially axially-extending, e.g., a herringbone pattern to facilitate such torque transmission from the insert segments 2606-2610 to the tubular 102.

In at least some embodiments, the insert segments 2408-2412 may be initially held in place in the respective pockets 2402-2406 by a shearable member, e.g., a shear screw or pin, received through the clamp segment 202 and into connection with the insert segments 2408-2412. This may permit assembly of the clamp assembly 106 onto the tubular 102. The shearable member may yield under relatively low axial loads, releasing the inserts 2408-2412 to move between the extended and retracted positions. It will be appreciated that any one or more of the other inserts 2308, 2310 (e.g., FIG. 24A) and pockets 2302, 2304 (e.g., FIG. 24A) may also be segmented/partitioned within a given embodiment, or may be continuous or formed in any other shape.

Figure 24B:
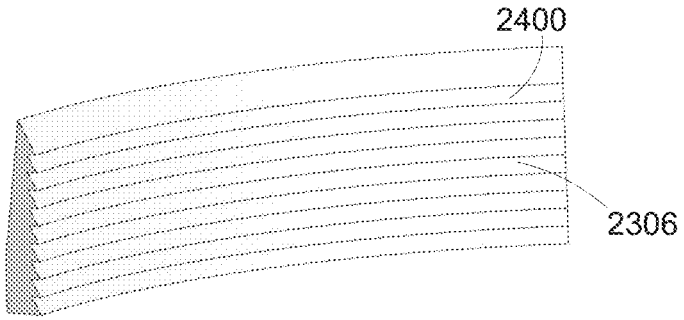
FIG. 24B illustrates a perspective view of the insert, according to an embodiment.

FIG. 24B illustrates a perspective view of the insert 2306, according to an embodiment, showing the arcuate shape, tapered profile, and the gripping surface 2400 in greater detail. It will be appreciated that the insert 2306 may be partitioned into smaller insert segments, as discussed above.

FIGS. 25A and 25B illustrate two partial views of the clamp segment 202 of the embodiment of FIG. 23 engaging the tubular 102. In particular, FIG. 25A shows the clamp segment 202 with the insert 2306 in the pocket 2300 in a retracted configuration. FIG. 25B shows the insert 2306 in the pocket 2300 in an actuated configuration. As noted above, a downward axial force may be applied to the clamp segment 202 (e.g., via the outer sleeve 104). This downward force may shift the clamp segment 202 downward. The insert 2306 is retained in place by the initial clamping force of the clamp segment 202 being connected to the clamp segment 204 (e.g., FIG. 24). According, the downward shifting of the clamp segment 202 causes the insert 2306 to ride along the tapered surface of the pocket 2300, which in turn drives the insert 2306 radially inward, pressing the insert 2306 into the tubular 102, as shown in FIG. 25B.

The insert 2306 is configured to make contact with the tubular 102 when the clamp assembly 104 is initially installed onto the tubular. This arrangement provides an axial preload onto the insert 2306 such that the clamp assembly 104 is held stationary via the initial preload and frictional engagement with the tubular. Once an axial load is applied to the torque reducer 100, the torque reducer 100 may move incrementally, but the insert 2306 is held stationary due to the frictional engagement with the tubular. The incremental differential movement between the insert 2306 and the clamp assembly 104, combined with the tapered engagement surface between the insert 2306 and the clamp segments 202, 204 results in an increase in the radial compressive load between the insert 2306 and the clamp segments 202, 204. In at least some embodiments, when the clamp assembly 104 has been installed onto the tubular, the insert 2306 contacts of the tubular. Thus, the insert 2306 may provide a gap between the tubular and the clamp segments 202, 204, while the insert 2306 itself engages the tubular, e.g., at all times while installed.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for reducing torque in a drill string, comprising:

a clamp assembly comprising a first clamp segment and a second clamp segment, the first and second clamp segments each being generally arcuate and configured to connect together so as to secure the clamp assembly around an oilfield tubular and prevent the clamp assembly from axial and rotational movement relative to the oilfield tubular, wherein the first and second clamp segments each include a first extension and a second extension, each of the first and second extensions having a tapered end that decreases in outer diameter as proceeding in an axial direction, so as to provide a conical guide surface; and an outer sleeve positioned around the clamp assembly, wherein the outer sleeve is configured to rotate with respect to the oilfield tubular and the clamp assembly, and is prevented from axial movement relative thereto.

2. The apparatus of claim 1, wherein the first and second extensions each provide an inboard facing shoulder surface , the respective inboard facing shoulder surfaces being engageable with axial ends of the outer sleeve, so as to prevent axial displacement of the outer sleeve relative to the clamp assembly, while permitting relative rotation therebetween.

3. The apparatus of claim 1, wherein the first and second clamp segments each include a central body defining a recessed region, and wherein the outer sleeve comprises an inwardly-extending protrusion configured to be received at least partially into the recessed region, so as to retain an axial positioning of the outer sleeve relative to the clamp assembly.

4. The apparatus of claim 3, wherein:

the central body of each of the first and second clamp segments defines a first recessed region, a second recessed region, and radial protrusion extending radially outward from and positioned axially between the first and second recessed regions; and the outer sleeve comprises a first radially-inwardly extending protrusion, a second radially-inwardly extending protrusion, and a recessed portion positioned between the first and second protrusions, the first protrusion being received into the first recessed region, the second protrusion being received into the second recessed region, and the recessed portion receiving the radial protrusion of the central body.

5. The apparatus of claim 4, wherein the first and second clamp segments each define at least four axially-facing shoulder surfaces, and wherein the outer sleeve defines at least four axially-facing shoulder surfaces, the at least four shoulder surfaces of the outer sleeve being engageable with the at least four shoulder surfaces of the first and second clamp segments.

6. The apparatus of claim 1, wherein:

the first and second clamp segments each include a central body defining a first recessed region, a second recessed region, a third recessed region, a first radial protrusion extending radially outward from and positioned axially between the first and second recessed regions, and a second radial protrusion extending radially outward from and positioned axially between the second and third recessed regions; and the outer sleeve comprises a first radially-inward extending protrusion, a second radially- inward extending protrusion, a third radially extending protrusion, a first recessed portion positioned between the first and second protrusions, and a second recessed portion positioned between the second and third protrusions, the first protrusion, second protrusion, and third protrusion of the outer sleeve being received into the first recessed region, second recessed region, and third recessed region of the first and second clamp segments, respectively.

7. The apparatus of claim 1, wherein the clamp assembly further comprises at least one releasable fastener that secures the first clamp segment directly to the second clamp segment and around the oilfield tubular, such that the first and second clamp segments apply a gripping force to the oilfield tubular.

8. The apparatus of claim 1, wherein the outer sleeve comprises a first sleeve segment, a second sleeve segment, a pin, a first knuckle extending from the first sleeve segment, and a second knuckle extending from the second sleeve segment, the pin being configured to be received into both the first and second knuckles so as to secure the first and second knuckles together.

9. The apparatus of claim 1, wherein the outer sleeve is configured to slide axially against a surrounding tubular or wellbore into which the oilfield tubular is deployed, and wherein the oilfield tubular is configured to rotate relative to the surrounding tubular or wellbore.

10. The apparatus of claim 1, wherein the clamp assembly further comprises a plurality of lock inserts configured to fit radially between the first clamp segment, the second clamp segment, or both and the oilfield tubular, so as to secure the clamp assembly to the oilfield tubular.

11. The apparatus of claim 10, wherein the lock inserts each comprises a plurality of insert segments, and wherein the first clamp segment and the second clamp segment each include a plurality of pockets on an inner surface thereof, the insert segments being configured to be positioned in the pockets.

12. The apparatus of claim 11, wherein the plurality of insert segments are configured to space at least a portion of the first clamp segment and at least a portion of the second clamp segment radially apart from the oilfield tubular.

13. The apparatus of claim 11, wherein the plurality of insert segments have a tapered profile, such that an axial force applied to the first clamp segment, the second clamp segment, or both drives the plurality of insert segments radially inward.

14. The apparatus of claim 11, wherein the plurality of insert segments have teeth on an inner surface thereof, the teeth being configured to bite into the oilfield tubular when the plurality of insert segments are driven radially inward, and wherein at least a portion of the teeth forms a bearing surface that extends at least partially in an axial direction, so as to interact with the oilfield tubular to resist axial and circumferential movement of the insert segments.

15. The apparatus of claim 11, wherein the plurality of lock segments each have a grip coating on an inner surface thereof., the grip coating configured to interact with the oilfield tubular when the plurality of lock segments are driven radially inward so as resist axial and circumferential movement of the lock segments.

16. The apparatus of claim 11, wherein the plurality of insert segments each include circumferential end surfaces that are configured to engage with side surfaces of the pockets, such that the insert segments are configured to resist rotation of the first and second clamp segments relative to the oilfield tubular.

17. The apparatus of claim 1, wherein at least one of the first clamp segment, the second clamp segment, or the outer sleeve includes a wear groove that is configured to provide a visual indication of a reduction of material in which the wear groove is formed.

18. A method, comprising:

securing a first clamp segment together with a second clamp segment and around a tubular, such that the first and second clamp segments resist axial and radial movement relative to the tubular, wherein the first and second clamp segments each include first and second extensions, each of the first and second extensions having a tapered end; and positioning an outer sleeve around the first and second clamp segments, wherein the outer sleeve is configured to rotate relative to the first and second clamp segments, and wherein the outer sleeve is received axially between the tapered ends of the first clamp segment and axially between the tapered ends of the second clamp segment.

19. The method of claim 18, further comprising:

positioning a plurality of lock inserts into pockets formed in the first and second clamp segments prior to securing the first and second clamp segments together around the tubular, wherein securing the first clamp segment together with the second clamp segment presses the plurality of lock inserts into the tubular, wherein the plurality of lock inserts maintain a gap in a radial direction between the tubular and at least a portion of the first and second clamp segments.

20. The method of claim 19, wherein the lock inserts have a tapered profile, such that an axial force applied to the first clamp segment, the second clamp segment, or both drives the lock inserts radially inward.

21. The method of claim 19, wherein the lock inserts define one or more teeth that are configured to bite into a wall of the tubular, or wherein the lock inserts have a coating on an inner surface thereof, or both so as to interact with the tubular to resist axial and circumferential movement of the lock inserts.

22. An apparatus for reducing torque in a drill string, comprising:

a clamp assembly comprising a first clamp segment and a second clamp segment, the first and second clamp segments each being generally arcuate and configured to connect together so as to secure the clamp assembly around an oilfield tubular and prevent the clamp assembly from axial and rotational movement relative to the oilfield tubular, wherein the first and second clamp segments each include a first extension and a second extension, each of the first and second extensions having a tapered end that decreases in outer diameter as proceeding in an axial direction, so as to provide a conical guide surface, wherein the first and second clamp segments each include at least one radial protrusion and at least two recesses, wherein the clamp assembly further includes a plurality of lock inserts each having a tapered profile and configured to fit radially between the first clamp segment, the second clamp segment, or both and the oilfield tubular, so as to secure the clamp assembly to the oilfield tubular, wherein the lock inserts each comprises a plurality of insert segments, and wherein the first clamp segment and the second clamp segment each include a plurality of pockets on an inner surface thereof, the insert segments being configured to be positioned in the pockets between axially-extending walls of the first and second clamp segments; and an outer sleeve positioned around the clamp assembly and including at least one radial protrusion configured to fit into the at least one recess of the first and second clamp segments, and at least one recess configured to receive the at least one protrusion of the first and second clamp segments, such that multiple load-transferring interfaces are formed between shoulder surfaces of the clamp assembly and shoulder surfaces of the outer sleeve, wherein the outer sleeve is configured to rotate with respect to the oilfield tubular and the clamp assembly, and is prevented from axial movement relative thereto, wherein the first and second clamp segments each include a central body defining a recessed region, and wherein the outer sleeve comprises an inwardly-extending protrusion configured to be received at least partially into the recessed region, so as to retain an axial positioning of the outer sleeve relative to the clamp assembly.

* * * * *